US007572185B2

(12) United States Patent
Seelig et al.

(10) Patent No.: US 7,572,185 B2
(45) **Date of Patent: *Aug. 11, 2009**

(54) GAMING DEVICE WITH ANIMATED FIGURE AND MOVABLE OBJECT DISPLAY

(75) Inventors: Jerald C. Seelig, Absecon, NJ (US); Lawrence M. Henshaw, Hommonton, NJ (US)

(73) Assignee: Atlantic City Coin & Slot Service Company, Inc., Pleasnatville, NJ (US)

( * ) Notice: Subject to any disclaimer, the term of this patent is extended or adjusted under 35 U.S.C. 154(b) by 596 days.

This patent is subject to a terminal disclaimer.

(21) Appl. No.: 11/241,505

(22) Filed: Sep. 30, 2005

(65) Prior Publication Data

US 2007/0117603 A1 May 24, 2007

Related U.S. Application Data

(63) Continuation-in-part of application No. 11/138,934, filed on May 25, 2005, now Pat. No. 7,335,103.

(60) Provisional application No. 60/615,266, filed on Oct. 1, 2004.

(51) Int. Cl.
*G07F 17/34* (2006.01)
*A63F 7/00* (2006.01)

(52) U.S. Cl. ..... 463/32; 463/20; 463/25; 463/46; 273/143 R

(58) Field of Classification Search ..... 463/20, 463/46, 12, 13, 16–19, 32; 273/143 R
See application file for complete search history.

(56) References Cited

U.S. PATENT DOCUMENTS 0,088,756 A 4/1869 Trump
0,468,338 A 2/1892 Goodson (Continued)

FOREIGN PATENT DOCUMENTS

GB 2273384 5/1994

(Continued)

OTHER PUBLICATIONS

"Empire" ACC in "Strictly Slots" 1998 Dec. 1998, p. 40 Casino Publishing Group, Pleasantville, New Jersey.

(Continued)

*Primary Examiner*—Benjamin H Layno
(74) *Attorney, Agent, or Firm*—Ian F. Burns & Associates

(57) ABSTRACT

An animated gaming system that includes a housing configured to hold gaming components, a game controller, a three-dimensional animated figure and at least two display containers located in the housing, is disclosed. The display containers are configured to hold and agitate moveable display objects, for example display balls. The containers are at least partially transparent allowing players to view the moveable display objects, such as in a jumbled ball display. The three-dimensional animated figure includes at least one animated element that is movable and the animated figure can be made to appear to indicate at least one of the containers and subsequent display of a prize object. A gaming method involving use of the animated figure and containers with moveable display objects is also disclosed.

27 Claims, 15 Drawing Sheets

U.S. PATENT DOCUMENTS

| | | | |
|---|---|---|---|
| 0,507,768 | A | 10/1893 | Waldman |
| 1,093,577 | A | 4/1914 | Palmer |
| 1,257,045 | A | 2/1918 | Stotler |
| 1,398,462 | A | 11/1921 | Knowles |
| 1,599,156 | A | 9/1926 | Wilnin et al. |
| 2,148,612 | A | 2/1939 | French Reginald D |
| 2,188,292 | A | 1/1940 | Hall et al |
| 2,368,088 | A | 1/1945 | Brewer |
| 2,508,146 | A | 5/1950 | D'Elia |
| 3,545,759 | A | 12/1970 | Stossl et al. |
| 3,650,065 | A | 3/1972 | Johmann |
| 3,684,891 | A | 8/1972 | Johmann |
| 3,705,726 | A | 12/1972 | Johmann |
| 3,740,039 | A | 6/1973 | Prola |
| 3,815,912 | A | 6/1974 | Wichinsky et al |
| 4,871,171 | A | 10/1989 | Rivero |
| 4,909,513 | A | 3/1990 | Kiyono |
| 5,031,913 | A | 7/1991 | Hirosumi et al. |
| 5,062,635 | A | 11/1991 | Tse et al. |
| 5,088,737 | A | 2/1992 | Frank et al. |
| 5,380,007 | A | 1/1995 | Travis et al. |
| 5,566,940 | A | 10/1996 | Powell |
| 5,584,763 | A | 12/1996 | Kelly et al. |
| 5,697,843 | A | 12/1997 | Manship et al. |
| 5,882,261 | A | 3/1999 | Adams |
| 5,951,009 | A | 9/1999 | Miyamoto et al. |
| 6,152,447 | A | 11/2000 | Stanley |
| 6,302,790 | B1 | 10/2001 | Brossard |
| 6,315,660 | B1 | 11/2001 | DeMar et al. |
| 6,322,071 | B1 | 11/2001 | Chaaban |
| 6,336,863 | B1 | 1/2002 | Baerlocher et al. |
| 6,394,898 | B1 | 5/2002 | Nagao et al. |
| 6,394,901 | B1 | 5/2002 | Marta |
| 6,398,219 | B1 | 6/2002 | Pierce et al. |
| 6,398,220 | B1 | 6/2002 | Inoue |
| 6,537,152 | B2 * | 3/2003 | Seelig et al. ..... 463/30 |
| 6,712,694 | B1 | 3/2004 | Nordman |
| 6,746,329 | B1 | 6/2004 | Duhamel |
| 6,793,577 | B1 | 9/2004 | Wilkins et al. |
| 6,905,407 | B2 | 6/2005 | Nordman |
| 7,241,220 | B2 * | 7/2007 | Rothkranz et al. ..... 463/20 |
| 7,335,103 | B2 * | 2/2008 | Seelig et al. ..... 463/22 |
| 2002/0160826 | A1 | 10/2002 | Gomez et al. |
| 2004/0002373 | A1 | 1/2004 | Kaminkow |
| 2004/0018865 | A1 | 1/2004 | Gilmore et al. |
| 2005/0054422 | A1 | 3/2005 | Rothkranz et al. |

FOREIGN PATENT DOCUMENTS

| | | |
|---|---|---|
| JP | 6 277347 | 10/1994 |
| JP | 9 108431 | 10/1997 |
| WO | WO 9814251 | 4/1998 |

OTHER PUBLICATIONS

"Jungle King" ACC in Strictly Slots 1999 Mar. 1999, p. 41, Casino Publishing Group, Pleasantville, New Jersey.
"Slot Machines" by Fey Library of Congress No. 93-081047.

* cited by examiner

GAMING DEVICE WITH ANIMATED FIGURE AND MOVABLE OBJECT DISPLAY

CROSS REFERENCES TO RELATED APPLICATIONS

The present application is a continuation-in-part application of U.S. application Ser. No. 11/138,934, filed on May 25, 2005 now U.S. Pat. No. 7,335,103. The present application also claims priority of U.S. provisional patent application 60/615,266, filed on Oct. 1, 2004. All of the above referenced applications are hereby expressly incorporated herein by reference in their entireties.

BACKGROUND

Field of the Invention

The present invention relates to a gaming system having an animated figure and a display device including moveable objects in a container. More particularly, the gaming system involves a three-dimensional animated figure that indicates a prize based on a display of moveable objects within two or more containers.

Gaming Devices

Gaming devices are well known in the art and a large variety of gaming devices have been developed. In general, gaming devices allow users or players to play a game. In many casino-type gaming devices, the outcome of the game depends, at least in part, on a randomly generated event. For example, a gaming device may use a random number generator to generate a random or pseudo-random number. The random number may then be compared to a predefined table to determine the outcome of the event. If the random number falls within a certain range of numbers on the table, the player may win a predefined prize. The table also may contain display information that allows the gaming device to generate a display that corresponds to the outcome of the game. The gaming device may present the outcome of the game on a large variety of display devices, such as mechanical spinning reels or video screens.

Display Devices

In addition, highly visible display devices are utilized on gaming devices in order to attract players. Once players are attracted to the gaming device, they tend to play longer because the display device enhances the stimulation and excitement experienced by players. It is, therefore, desirable for gaming devices to incorporate highly visible display devices.

Display devices tend to be more successful if they are a derivation of a well-known game or theme. They are more successful because players tend to be drawn to games that they instantly recognize. Many players are reluctant to try completely new games because they must learn the new game. It is, therefore, desirable to provide display devices that are based on well-known games or themes.

Display devices tend to be more successful if they utilize physical objects rather than simulations. Although video devices and electronic signs can be used for display devices, players are more attracted to display devices that utilize physical objects. Physical objects can be even more effective display devices if they are moveable and they are used in combination with lights and sounds. With the movement of objects within display devices, it is advantageous to use transport devices that will attain maximum effectiveness while occupying a minimum amount of space. It is important to minimize the amount of occupied space because a smaller gaming device generally corresponds to an overall lower cost.

Jumbled Ball Displays

Two references that have attempted to utilize jumbled ball displays are U.S. Pat. No. 4,871,171 issued to Rivero and U.S. Pat. No. 5,380,007 issued to Travis et al. Rivero appears to disclose a game device with means for simulating the release of a ball. In this reference, a rotating drum is provided with numbered balls, and as the drum rotates, a ball is released into a transparent tube. However, Rivero is not intended to show the player the ball that is released from the drum. Rather, the ball is held in the tube, out of view of the player, and an electronic simulation of the ball number is presented in a window. This is intended to give the player "the impression" that the ball has been counted. Rivero fails to disclose or suggest displaying actual balls to the player to indicate the outcome of the game or the value of a prize. In addition, in the Rivero device the balls are in a cage and quite exposed to the environment and tampering. The ball cage of Rivero is also mounted on the front side and well below the top of the gaming machine, hiding the ball cage from view of potential game players who are not in position to see the front side of the machine.

Travis appears to disclose a video lottery gaming device with numbered balls. However, all of the balls are simulations generated by software and no physical balls are displayed to the player. Travis et al. also fails to disclose or suggest displaying actual balls to the player to indicate the outcome of the game or the value of a prize.

One of the disadvantages with Rivero and Travis et al. is that no actual physical balls are used to display the outcome of a game. This is less desirable because players like to see physical objects rather than electronic simulations of the physical objects. Moreover, players tend to believe that a game device is misleading when the device purports to display a simulation of an object rather than the object itself. This is especially true when the object itself could be viewed directly rather than a simulation as is the case in Rivero.

Games having Animated Characters

It is well known that games of chance, such as slot machines, may have an animated character that operates in conjunction with a game of chance. For example, in Slot Machines, by Marshall Fey, a slot machine called "Shoot the Bear" is described in which a bear stands up and growls when a jackpot is hit. More generally, animated characters are well known. For example, in U.S. Pat. No. 4,799,678, a device is described that interacts with an animated character to simulate a game show. More particularly, this document describes an electronic game playing device with a synthesized voice and an animated game show host character. The animated game show host character has different features such as eyes, head and arms that are activated at different times in response to synthesized voice or the output of an audio tape.

Bonus Prizes

Some gaming devices award bonuses in addition to prizes that are awarded in the primary game. A bonus can be defined as an additional prize that is awarded to the player when a predefined event occurs. An example of a bonus game can be found in U.S. Pat. No. 5,848,932 issued to Adams. One of the gaming devices described in this document comprises three spinning reels and a spinning wheel bonus display. When predetermined indicia are displayed on the spinning reels of the primary game, the wheel can be activated to indicate a bonus prize. The bonus prize is awarded in addition to any prizes awarded in the primary game.

In another embodiment described in this document, the gaming device includes a container having one or more movable objects and a transport device for transporting the one or more movable objects within the container. When predetermined symbols are displayed on the reels of the primary game, the transport device can be activated to transport the movable objects while the player is allowed to play the bonus game.

Generally, bonus prizes are offered in such games in order to increase the excitement and enjoyment experienced by players. This attracts more players to the game and encourages players to play longer. When gaming devices attract more players and the players play longer, they tend to be more commercially successful relative to other gaming devices.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to provide game players with a more exciting and desirable gaming experience;

the ability to attract more patrons to play a game;

provide longer play times and a greater payout possibility for a player;

provide greater revenues for gaming operators;

provide a gaming system that utilizes a visually appealing and highly visible display device;

provide a gaming system having an animated figure that identifies a prize;

provide a control system for controlling the actions of an animated gaming system;

provide an animated gaming system that may be used as a stand-alone game;

provide an animated gaming system that may be used in combination with another gaming device;

provide an animated gaming system that may be engaged after a bonus-triggering event; and provide a gaming system having an animated figure that requires little maintenance;

provide an animated figure that displays like-like movement;

provide an animated figure that can display spontaneous movement;

provide an animated figure that displays three dimensional motion;

provide an animated figure that displays a variety of different kinds of movement;

provide an animated figure that displays complex motion;

These and other advantages may be realized by reference to the remaining portions of the specification, claims and abstract.

BRIEF DESCRIPTION OF ONE EMBODIMENT OF THE PRESENT INVENTION

The present invention involves a gaming system having at least one game apparatus, at least one controller, at least one housing coupled to the game apparatus, at least one physical three-dimensional animated figure, a plurality of moveable display objects and at least two containers configured to hold the moveable display objects. The containers typically have at least one portion that is at least partially transparent so that a player may view the moveable display objects. The gaming system further includes an agitator associated with the containers that is used to move the moveable display objects within the containers, a plurality of prize objects having game related indicia and at least one prize object holder associated with the containers and configured to hold a prize object in a controlled manner. The controller is configured to control game functions and components, present a game to a player, randomly determine a game outcome, select a prize object from the prize object holder corresponding to the game outcome, and communicate with a prize display mechanism that is configured to display the selected prize object. The three-dimensional animated figure includes at least one animated element moveable between at least two positions; the animated element is typically part of, or operatively coupled to, the animated figure. In at least one position, the animated element indicates, and may be proximate to, at least one of the containers. The physical animated figure may also be coupled to an actuator located in the housing where the actuator is configured to move the animated element in response to signals from the controller. The animated figure can be made to appear to indicate at least one of the containers holding the moveable display objects.

The present invention further discloses a gaming method involving allowing a player to wager and play a game of chance having a random game outcome where the random game outcome is determined using a controller. The method further involves displaying a plurality of moveable display objects in at least two containers where each container allows the player to view the moveable display objects. A plurality of prize objects having game related indicia, and separated from the moveable display objects, are also provided. The method further includes moving at least a portion of a moveable three-dimensional animated figure using an actuator in response to a signal received from the controller to indicate one of the containers. The method further selects a prize object from a prize object holder where the selected prize object corresponds to the random game outcome and then displays the selected prize object. The method may also involve hiding the prize objects in the prize object holder from view of the player. The method may further include a primary game where at least a part of the aforementioned steps represent a bonus game in association with the primary game.

The above description sets forth, rather broadly, a summary of some embodiments of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF SOME EMBODIMENTS OF THE PRESENT INVENTION

In the following detailed description of certain embodiments of the invention, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

In the Detailed Description below, the applicants utilize various spatially orienting terms such as "upper," "lower," "horizontal," and "vertical." It is to be understood that these terms are used for ease of description of the preferred embodiments with respect to the drawings but are not necessarily in themselves limiting or requiring of an orientation as thereby described in the following Detailed Description.

Figure 1:
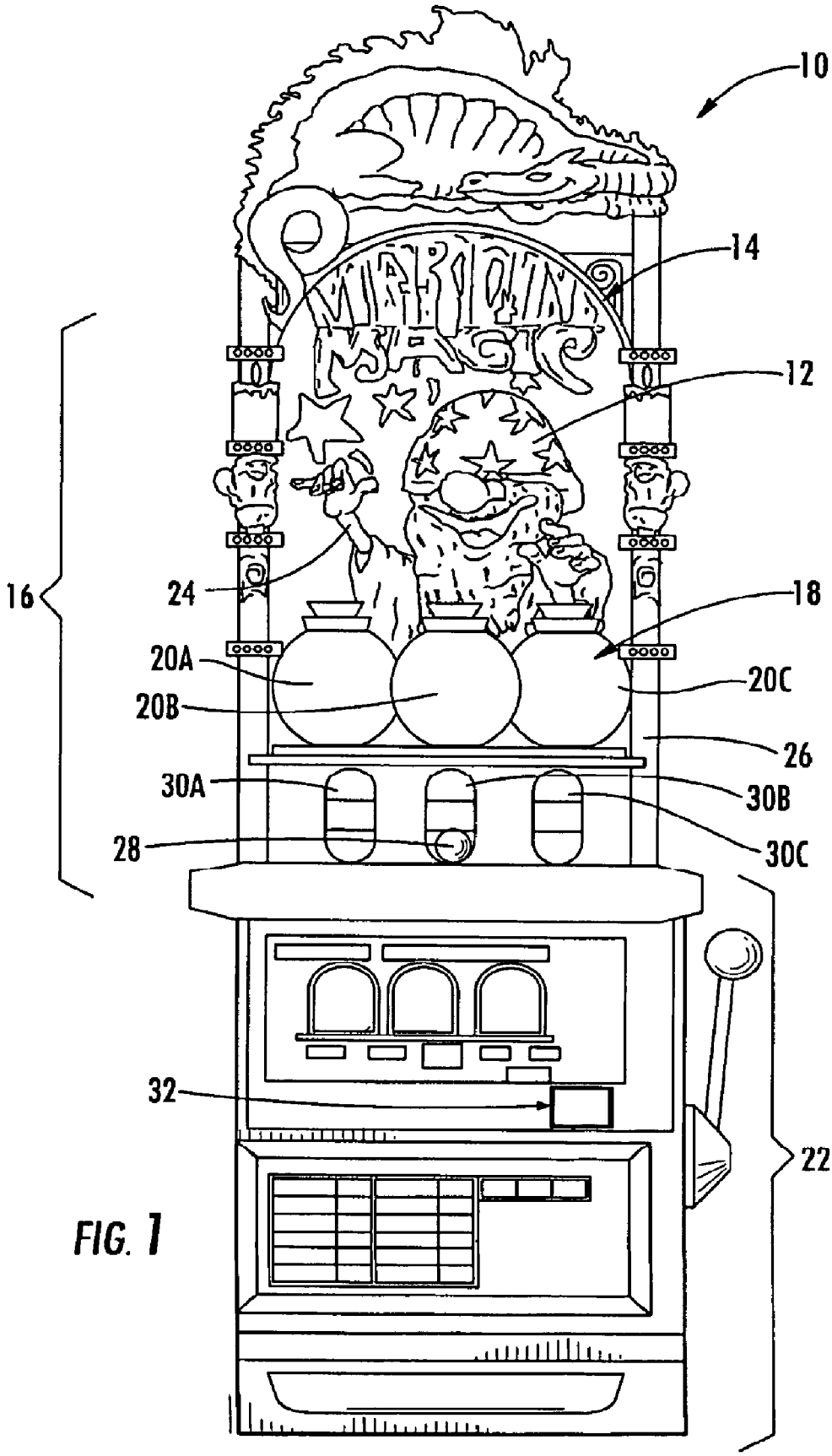
FIG. 1 is substantially a front perspective view of a gaming system having an animated figure that identifies a display container subsequently providing display of a prize object.

The present invention involves an animated gaming system, an example of which is shown in FIG. 1. The animated gaming system is indicated by reference number 10 and it comprises a three-dimensional animated FIG. 12 that is operatively coupled to a housing 14. Housing 14 is coupled to gaming apparatus 22. Typically, animated FIG. 12 comprises one or more robotic components or animated elements 24 (in this case, arms) in communication with a control system (not shown). Display area 16 includes a plurality of moveable display objects 18 (shown here as balls) held within containers 20 (three shown in FIG. 1). Containers 20 include containers 20*a*, 20*b* and 20*c*. Display area 16 also includes at least one prize object holder (not shown), associated with containers 20. The prize object holders are configured to hold prize objects 28 in an individually controlled manner. The prize object holder may be configured to be coupled with one or more of the containers 20. Alternatively, two or more prize object holders may be used, each one associated with a specific container 20.

In operation, the movements of animated FIG. 12 are determined by the control system. In one embodiment, a game outcome is determined by the control system, the animated element 24 of animated FIG. 12 is directed to move and point to one of containers 20, and display mechanism 26 presents the result of the game outcome to the player by displaying a prize object 28 in one of windows 30 of display mechanism 26. Each window 30 corresponds to a specific container 20. For example, if container 20*a* is pointed to by FIG. 12*a*, a prize object would be displayed in window 30*a*. The animated gaming system 10 may be operated as a stand-alone machine or in combination with another gaming device. The animated gaming system 10 and some of its variations are described in further detail below.

Animate can be defined as to make, build, equip or design in such a way that automatic, apparently spontaneous and like-like movement is effected.

Animated FIG. 12 may be in the form of a realistic or fictional animal. Suitable animated figures include, for example, representations of all or part of an animal, those figures having human features and being human-like, animals, birds, cartoon characters, boats, automobiles and train cars. Animated FIG. 12 may be capable of producing apparently spontaneous, lifelike motion. In addition, animated FIG. 12 may be capable of displaying spontaneous motion in three dimensions, a plurality of different kinds of motion, complex motion, or the coordinated movement of different elements.

Animated FIG. 12 can be a 3-dimensional figure that displays complex coordinated movement of animated elements. Animated FIG. 12 can also portray an animated scene. In another embodiment, animated FIG. 12 can be a 3-dimensional structure that performs spontaneous 3-dimensional motion.

Animated FIG. 12 may be a relatively simple device that generates limited sounds and provides limited kinds of motion. Alternatively, the animated FIG. 12 could be a sophisticated system having the ability to speak and to make very precise and complex movements. It shall be appreciated by those skilled in the art having the benefit of this disclosure that the description of "animated figure" includes robots that are commonly used in other industries and are commonly available in the marketplace. Such robots and the sources for these robots are described in the book entitled *Illusion of Life: Lifelike Robots,* by Gene William Poor, published in 1991 by Creative Learning Systems, Inc. of San Diego, Calif.

Figure 2:
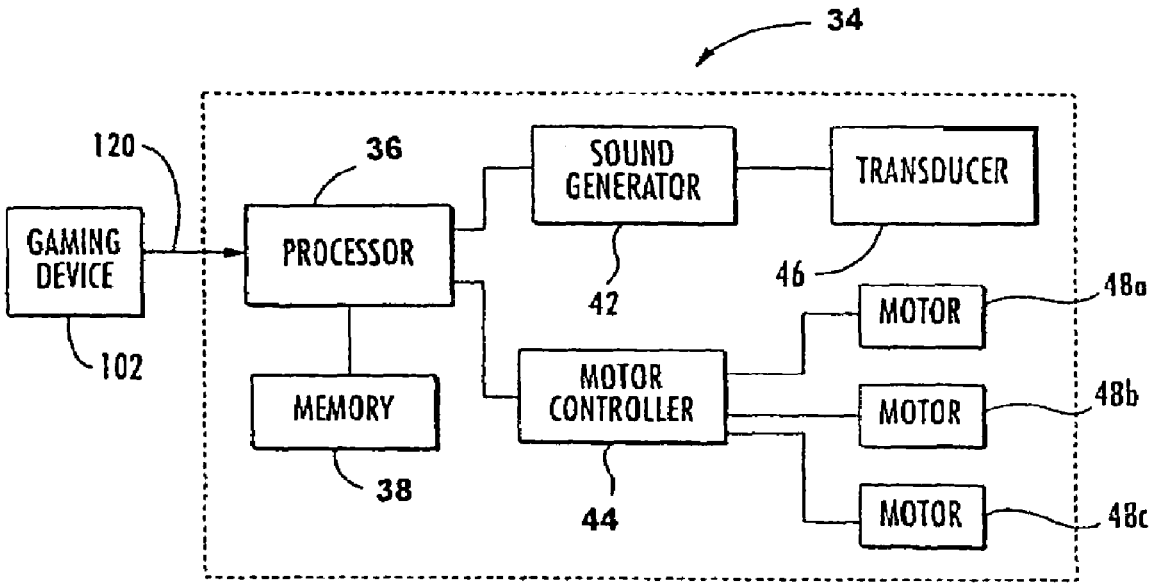
FIG. 2 is substantially a block diagram of a system for controlling the gaming system of FIG. 1.

Referring to FIG. 2, there is shown a block diagram of one possible control system 34 that controls the operations of animated FIG. 12. The boundary conditions for control system 34 are provided to teach some of the functions of control system 34 and are not intended to restrict the method and type of control system used. By way of example, animated FIG. 12 may be controlled by processor 36. Additionally, processor 36 is configured to communicate with a memory 38. Memory 38 may store software programs or may provide caching functionality. Memory 38 may comprise flash memory, EEPROM, EPROM, ROM, SRAM, DRAM or other forms of memory. An electrical output line 120 from a gaming device 102 is configured to carry the output signal from the gaming device 102 to animated FIG. 12 via processor 36.

In operation, animated gaming system 10 may be activated by insertion or transfer of value into a value receiving device 32 (shown in FIG. 1), which is in communication with processor 36. Value receiving device 32 may receive a variety of different kinds of media that represent or transfer value, including for example, coins, paper currency, coupons, tickets, vouchers, credit cards, debit cards, electronic credits or any other such transactional media.

In one embodiment, processor 36, in combination with memory 38 and random number generator software, is configured to generate a random number. In an alternative embodiment, an integrated circuit may be configured to generate a random number. The random number generator produces a random or pseudo-random number for each game of animated gaming system 10. The outcome of the game played on animated gaming system 10 may be determined by comparing the random number to a table of outcomes stored in a memory (which may be memory 38) and accessed by processor 36. The combination of processor 36 and memory 38 causes animated gaming system 10 to display the outcome of the game that corresponds to the outcome of the random number generator and table. Animated gaming system 10 may operate in many other ways and still achieve the objects of the present invention.

The random number may be used to determine the prize to be awarded according to a table, which may be referred to as a "pay table." A number of different tables of outcomes may be used and different tables may be used for different games. The tables can be designed so that different prizes have different probabilities of being awarded. Such design techniques are well known in gaming. Examples of such designs are shown in U.S. Pat. No. 4,448,419, issued to Telnaes; U.S. Pat. No. 5,456,465, issued to Durham; and U.S. Pat. No. 5,823,874, issued to Adams.

Initially the game outcome identifies one of the containers to be identified. After a specific container is indicated, a prize object is displayed (see discussion below) in one of windows 30 of display mechanism 26 (FIG. 1).

A simple pay table may appear as follows:

| Random Number | Location Number | Amount Paid |
|---|---|---|
| 0.00 to 0.03 | 1A | $25.00 |
| 0.04 to 0.20 | 1B | 0.00 |
| 0.21 to 0.26 | 1C | $ 5.00 |
| 0.27 to 0.76 | 2A | 0.00 |
| 0.77 to 0.82 | 2B | $30.00 |
| 0.83 to 0.84 | 2C | Progressive |
| 0.85 to 0.89 | 3A | Free Play |
| 0.90 to 0.95 | 3B | Multiplier ×2 |
| 0.96 to 1.00 | 3C | Other Symbol |

For example, if the random number generator produced a 0.03 value, the animated element 24 would move and point to location number 1A (in this case, container 1). The control system would select a $25.00 prize ball (prize object 28) from the prize object holder (not shown) and display the $25.00 prize ball as prize object 28 (FIG. 1) and $25.00 would be awarded to the player. Similarly, if the random number generator indicated location numbers 2A, 2B or 2C (pay table), then animated element 24 would move and point to container 2 and the appropriate prize object would be selected and displayed by the control system.

The present invention is not limited to the example pay table shown. A variety of different pay tables and prizes may be used. For each different housing 14, a new pay table identifying the appropriate location may be loaded into processor 36 and/or memory 38.

In others embodiment of the present invention, prizes may be awarded in the form of tickets, vouchers or coupons. For example, the tickets, vouchers and coupons may be dispensed using an internally or externally mounted dispenser (not shown in FIG. 1). Such dispensers are well known in the art. Additionally, a coin dispenser (not shown), well known in the art, may by used.

In an alternative embodiment, animated gaming system 10 includes an additional plurality of animated figures (not shown) within the same housing. The plurality of animated figures may be managed by control system 34. The plurality of animated figures may include a plurality of animated FIGS. 12 within one housing 14 wherein each of the plurality of animated figures may indicate (point to) a container 20, and in combination with the output from each of the animated figures, may result in a player being awarded a reward or prize or multiple prizes.

Control System

The control system preferably provides one or more outputs to control various game functions and components to carry out the functions of animated gaming system 10. Referring back to FIG. 2, animated FIG. 12 typically includes a controller or processor 36 in communication with a sound generator 42 and a motor controller 44. Control system 34 manages the signals that control the operations of animated FIG. 12. The boundary conditions for control system 34 describe some of the functions of control system 34. By way of the example, animated FIG. 12 may be controlled by processor 36 that is operatively coupled to memory 38. Memory 38 provides storage for various software programs or subroutines or may provide caching functionality. Although not shown, flash memory, EEPROM, EPROM, ROM, SRAM, DRAM and other forms of memory or any combination thereof may be used.

Sound generator 42 may provide local storage for a variety of different sounds. The variety of different sounds may be downloaded from processor 36 and memory 38 or the sounds may be pre-programmed in sound generator 42. Sound generator 42 communicates output signals to a transducer 46, such as a speaker, which generates an audible output.

Motor controller 44 may be configured to provide local storage for a variety of different commands that control actuators or motors 48*a*, 48*b*, and 48*c*. Motor controller 44 may receive commands from processor 36 or may have a plurality of commands stored locally in motor controller 44. Each motor 48*a*, 48*b*, and 48*c* may control and cause movement in one or more animated elements, such as, for example, an arm, finger, leg or mouth. For example, where the animated figure is in the form of an elephant, the animated element may be the trunk of the elephant and may be independently operated and moveable (or rotatable) between a plurality of positions by the controller. Additional animated elements can be included with animated FIG. 12 in order to enhance the appearance of the gaming device. For example, when animated FIG. 12 is in the form of an elephant, the eyes of the elephant can be made to shift from side to side or the elephant's ears can be made to move back and forth. These additional animated features can be correlated to the underlying game and controlled by the controller.

Figure 2A:
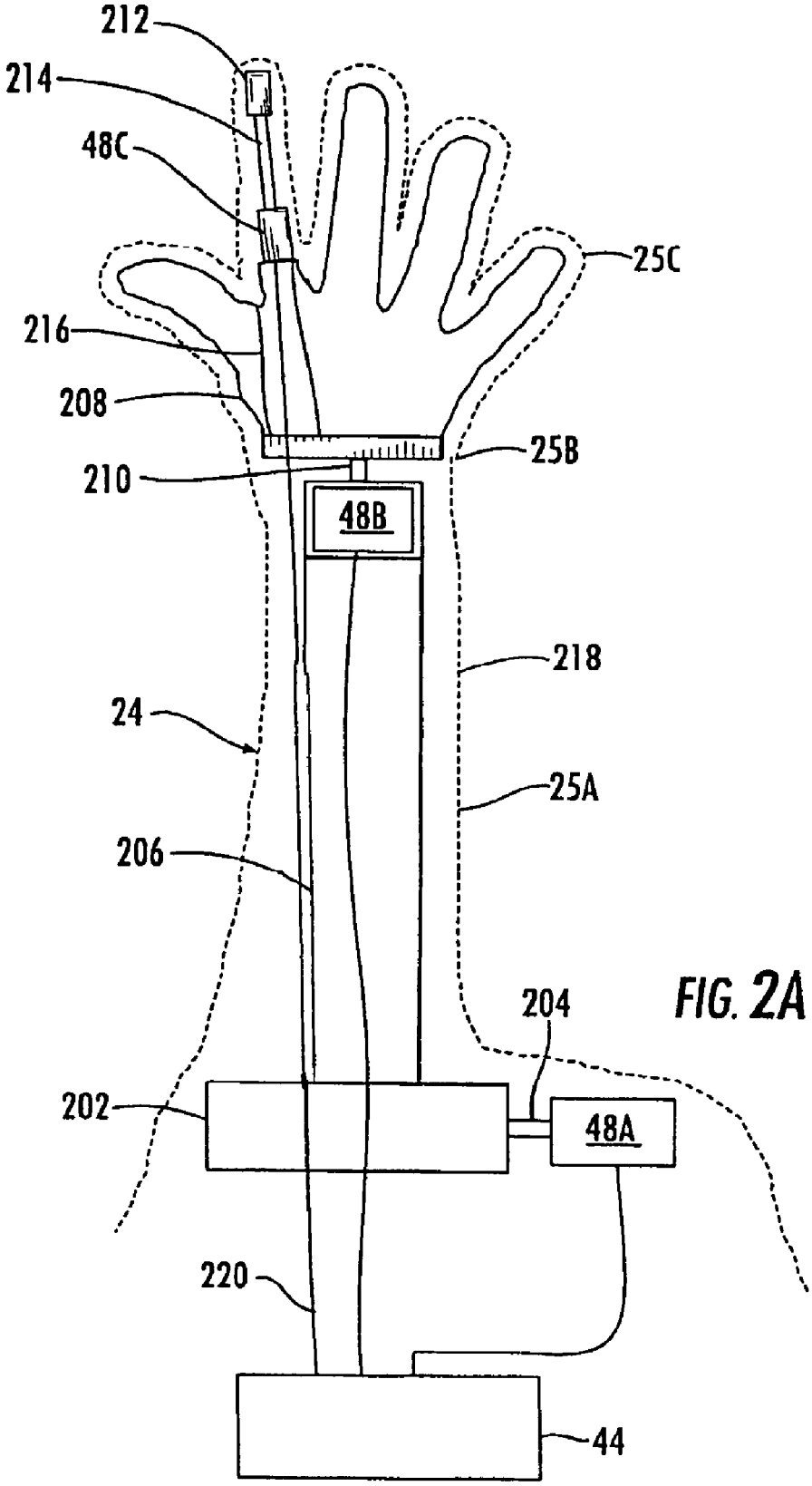
FIG. 2A is substantially an enlarged front view of the animated figure of FIG. 1.

Turning now to FIG. 2A, an enlarged view of an animated element 24 is shown. Animated element 24 is shown having an arm 25*a*, hand or wrist 25*b* and fingers 25*c*. Motor 48*a* can control the movement of arm 25*a*. Motor 48*b* can control the movement of hand 25*b* and motor 48*c* may control the movement of a finger 25*c*. Motors 48 can be rotary or linear motion motors.

Motor 48*a* can be connected to a base 202 by a shaft 204. A rod 206 is attached to base 202. The rotation of shaft 204 by motor 48*a* causes base 202 to rotate which causes rod 206 and arm 25*a* to swing or move simulating the movement of an arm.

Motor 48*b* can be connected to a rod 206 by a shaft 210. A plate 208 is attached to shaft 210. The rotation of plate 208 by shaft 210 causes hand 25*b* to rotate simulating the movement of a hand.

Motor 48*c* can be connected to a rod 212 by a shaft 214. Support member 216 connects plate 208 to motor 48*c*. Motor 48*c* can be a linear actuator. The movement of rod 212 by shaft 214 causes finger 25*c* to appear to be extending and retracting. The components of arm 25 can be covered with a material 218 in order to hide the motors and to resemble skin in order to enhance the appearance of arm 25.

In another embodiment, animated FIG. 12 may be represented by the form of a frog where the animated elements 24 may include the frog's head and the frog's tongue, where both the head and tongue are moveable. As described elsewhere, the head may be moved by an actuator. Components of suitable actuating mechanisms include, for example, worm gears, brackets, a biasing mechanism, a slider mechanism, motors (such stepper motors, servo motors, gear motors and DC motors). The animated FIG. 12 may include a tongue extending from the frog's head where the tongue be used to point to and indicate one of containers 20 holding the moveable display objects 18. In another embodiment, the frog's tongue may be moveable independently of the head. Typically, the frog's tongue is initially within the head or in a coiled configuration, extends to indicate a particular container, and then retracts back within the head (or re-coils). The frog's tongue may be actuated similarly to that previously described. Another example of an actuator that may be used is a pneumatic device that directs air into a hollow tongue, causing the frog's tongue to extend. Air pressure could be supplied by any suitable means, such as a solenoid driven plunger.

Although reference is made to motors, it is to be understood that other actuators, such as hydraulic or pneumatic devices, may be used in place of motors.

In a simple illustrative embodiment, animated FIG. 12 may comprise only a portion of an animal such as the head. When control system 34 generates the appropriate output, the mouth of animated FIG. 12 is moved according to motor controller 44 and a sound is generated according to sound generator 42.

In a more complex illustrative embodiment, animated FIG. 12 may take the shape of a lifelike human or cartoon character capable of sophisticated movements and speech. Animated FIG. 12 may be programmed to frown or cry and then console the gaming device player upon an indication that the player did not win a prize. Alternatively, animated FIG. 12 could be programmed to jump up and down and sing or scream such statements as, "You have won," or "You are a winner," for example. It may also be possible to have animated FIG. 12 do tricks such as somersaults or to throw candy or other safe projectiles at the game player.

Method for Operating the Animated Gaming System

Referring to FIGS. 1, 2, 2A and 3A, an example of a method 50 for operating animated gaming system 10 will now be described. At step 52, animated gaming system 10 may be engaged using a variety of methods. For example, a player may insert currency into value receiver device 32.

At step 54, method 50 proceeds to select a random number. It shall be appreciated by those skilled in the art that the use of a random number generator is well known in the art of gaming equipment. At step 56, method 50 compares the random number to a table to generate an outcome as described above. The outcome may be determined by another gaming apparatus in communication with animated gaming system 10. Preferably, the table includes a location number that is associated with a range of random numbers. Method 50 then proceeds to step 58.

At step 58 the outcome is identified and display of the result is initiated by animated FIG. 12. Using the table identified above, the location number is communicated to motor controller 44 and sound generator 42. Motor controller 44 and sound generator 42 generate the appropriate signals that are communicated to motors 48*a* through 48*c* and transducer 46, respectively. One of motors 48*a* through 48*c* moves animated element 24 to communicate an outcome of the game. Method 50 then proceeds to decision 60.

At decision 60 it is determined whether to continue the game or not. If it is decided that the game is to be continued, method 50 proceeds to step 52 and the animated gaming device is re-engaged. If it is decided that the game is not to be continued, the game is ended.

Figure 3A:
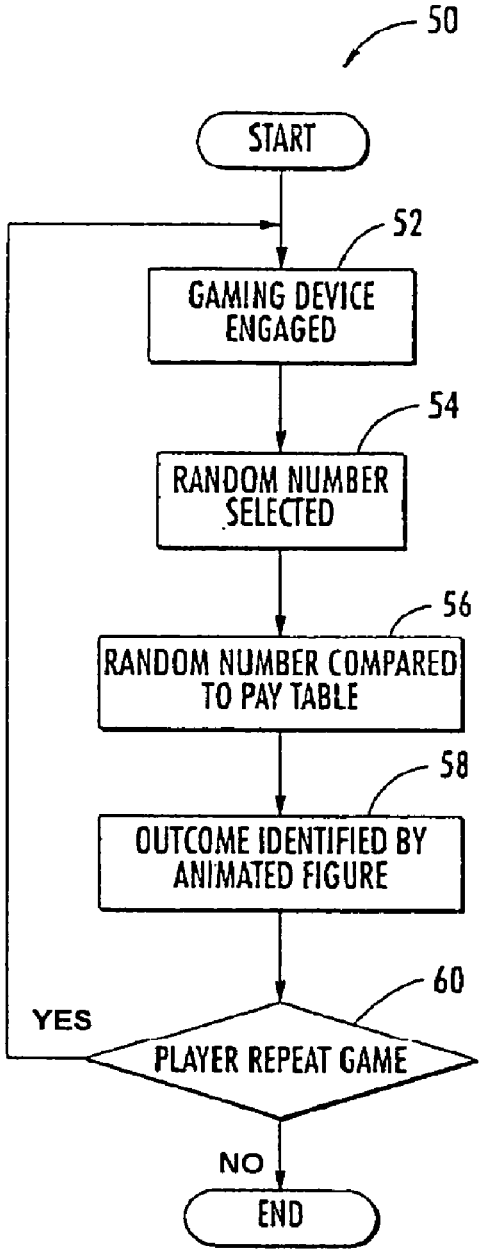
FIG. 3A is substantially a flow chart of the operation of the gaming system shown in FIG. 1.
Figure 3B:
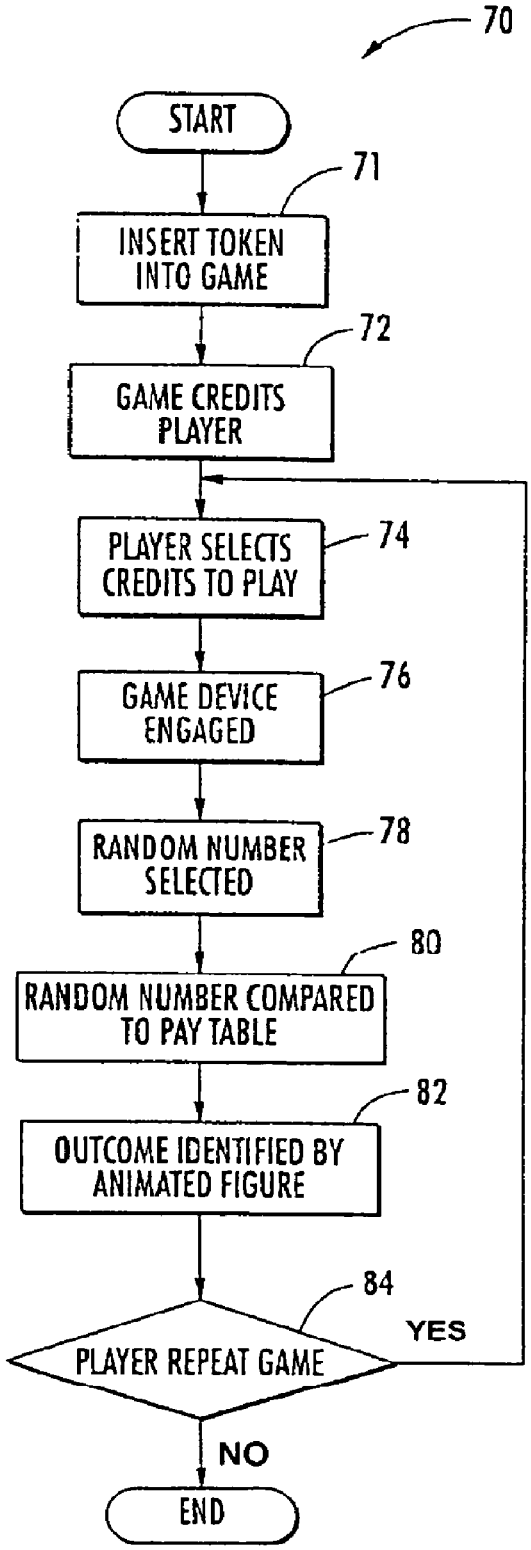
FIG. 3B is substantially a more detailed flow chart of the operation of the gaming system shown in FIGS. 1 through 3A.

Referring to FIG. 3B there is shown a more detailed method 70 for engaging the animated gaming system of FIG. 2. Steps 71, 72 and 74 describe the engagement of the animated gaming system described in FIG. 2.

At step 71, method 70 provides for the insertion of tokens into the animated gaming system. The insertion of tokens may be physical or may be electronic. Physical tokens include coins, paper currency, coupons, magnetic stripe cards and other related devices. Electronic tokens are generated by a network or may be generated by a storage media, such as a magnetic stripe card or smart card. The tokens are communicated to a value receiving device 32 as described above. Method 70 then proceeds to step 72.

At step 72, method 70 provides for the crediting of a player. The token is converted to credits by processor 36. The credits may be transferred or stored on the animated gaming system. Method 70 then proceeds to step 74.

At step 74, method 70 provides for permitting the player to select how many credits to play (or wager) on animated gaming system 10. For games of chance the credits played may be used to determine the size of the payment to the player, should the player be entitled to a prize or reward. However, it shall be appreciated by those skilled in the art that the present animated gaming system is not confined to games of chance. Method 70 then proceeds to step 76.

Steps 76, 78, 80 and 82 are substantially similar to steps 52, 54, 56 and 58, respectively. Therefore, the prior discussion of the functions performed in these steps is incorporated by reference. Method 70 then proceeds to decision 84.

At decision 84 it is determined whether to continue the game or not. If it is decided that the game is to be continued, method 70 proceeds to step 74 and the animated gaming device is re-engaged after the player selects the credits to play. If it is decided that the game is not to be continued, the game is ended.

Gaming Systems having Multiple Animated Elements

The animated figures may include more than one animated element and/or multiple movement modes. For example, the animated figure itself may move back and forth on a display, or may rock from side to side. In addition, animated elements may be included that are separate from the animated figure. The use of additional animated elements may serve to further increase player excitement, allow game developers more creative freedom in developing games for players, and allow game developers to develop new methods for awarding prizes.

The animated elements may simulate spontaneous lifelike 3-dimensional complex motion or movement.

For example, if the animated figure is in the form of a bird, the multiple animated elements may be represented by the wings of the bird. Each wing may be independently operated and moveable (or rotatable) between a plurality of positions by a controller.

In another embodiment, the animated figure may be disposed within the housing such that animated figure is completely recessed within the housing. A layer of glass, acrylic, plastic or other suitable (typically transparent) material may be placed in front of animated figure in order to protect animated figure and prevent tampering.

In another embodiment the animated gaming system may further include a display covering disposed over at least a portion of the display area where the display area may be viewed from outside the housing through the display covering where the display covering provides an aperture through which a portion of the animated figure extends from an interior of the housing and outside the display covering. The risk of tampering with the gaming device is reduced if animated elements are located behind display covering.

The animated figure may be mounted outside of the display covering. For example, animated figure may be a cut-out figure mounted to the external surface of the display covering. Alternatively, the animated figure may be secured to the glass by an adhesive material or may be attached to the interior of the housing. For example, animated figure may be mounted to one or more rods or shafts extending from the interior of the housing to the exterior of the housing; the animated figure could be secured to the rods or shafts by fastening means such as screws, pins, and other suitable fasteners known in the art.

In an alternative embodiment, the animated figure may be mounted such that it is both behind and in front of the display covering. The display covering may include an opening configured to allow the animated figure to pass through where the animated figure could be secured through previously discussed methods, such as by rods and shafts.

The visual appearance of the display area may be further be enhanced by including a changeable display portion to provide background in the form of changing images on at least part of the display area. The use of a changeable background can increase the game options available to game developers, the variety of prizes available to players, and the enjoyment and satisfaction experienced by game players. Suitable changeable background display portions may include, for example, an electronic display such as an LED display, LCD display, CRT tube or plasma screen device, including displays typically used for television and computer screens. Alternatively, the changeable background portion may be painted, drawn or otherwise imprinted on a material such as paper, canvas or plastics.

The changeable display portion can be incorporated into game play in a variety of ways. For example, the changeable background may be used to provide the illusion that an animated figure is in motion. At a more complex level, the movement of an animated figure can be correlated to the background being displayed on a changeable background. In addition, the changeable display portion may be correlated to the prize objects. At a higher level of complexity, a changeable background can be made to give the player the appearance of being able to control, or at least influence, the outcome of the game. For games of chance, regulations sometimes dictate that players have no control, and the outcome of a game is typically determined solely by a random number generator. By providing an illusion of player choice, player interest in playing the gaming device can be increased, while at the same time complying with regulatory requirements Other forms of animated FIG. 12 and animated elements may include the following. Animated FIG. 12 may take the form of a fisherman and the animated element 24 may be in the form of a fishing pole with a fishing line used to indicate a particular container 20. It will be appreciated that any combination of animated elements could be used. The use of multiple animated elements may increase the complexity of the apparatus but also increases the options available to the game developer and may increase the realism of animated element 24.

In one embodiment, prize objects 28 display indicia related to a game being played on the gaming apparatus. For example, the indicia may indicate that a player is entitled to a monetary bonus, may display the amount of the monetary bonus or the value of a bonus multiplier. Indicia may indicate that the player is entitled to a free play and/or the amount of free play.

FIGS. 4A-10 provide further detailed description of the animated gaming system of the present invention with emphasis on the display containers, the prize object holders and the prize display mechanism. For purposes of clarity, animated FIG. 12 is not shown and only one display container 20 is shown in the following figures. It is understood that animated FIG. 12 and at least two containers 20 are included in the present invention.

Figure 4A:
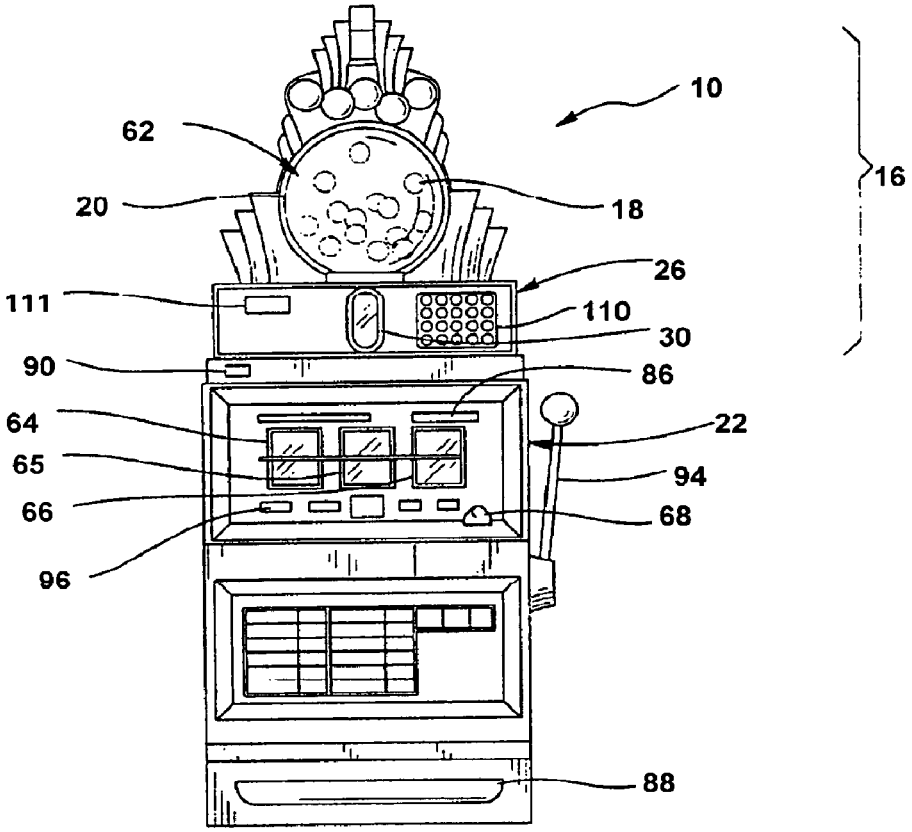
FIG. 4A is substantially a front view of a portion of the gaming system of the present invention.

FIG. 4A illustrates one embodiment of the present invention involving a jumbled ball display. The animated gaming system 10 (shown without housing 14, animated FIG. 12, and additional containers 20 from FIG. 1) includes display area 16 and a game apparatus 22. In this case, animated gaming system 10 includes a jumbled ball display container 62 (corresponding to one of containers 20 in FIG. 1) and prize object display 26. Only one window 30 is shown with prize object display 26 since there is only one container 20 involved in with this embodiment. The jumbled ball display container 62 contains moveable display objects 18 (in this case, balls).

With continuing reference to FIG. 4A, game apparatus 22 may be any of a large number of devices that is configured to allow players to play a game. For example, game apparatus 22 may utilize reel displays, such as spinning reels 64-66 or a video display (not shown), to display outcomes of the game. Means may also be provided for accepting wagers, such as a coin slot 68 or card reader 86, and for awarding prizes, such as a coin dispenser 88. A handle 94 and button 96 are provided for activating game apparatus 22 to begin a game. In at least one embodiment, game apparatus 22 may be an S2000™ or S Plus™ model gaming device manufactured by International Game Technology in Reno, Nev.

Game apparatus 22 is typically controlled by an electronic controller 98 (see FIG. 5) that utilizes a random number generator (analogous to control system 34 in FIG. 2). The random number generator produces a random or pseudo random number for each game and subsequent game outcome. The outcome of the game is accessed by controller 98. A number of different tables of outcomes may be used and different tables may be used for different games (see previous discussion). Game apparatus 22 may also be capable of producing a bonus-activating event. This event may be many different types of events. For example, a bonus-activating event may comprise displaying a particular symbol, such as a "bonus" symbol, or combination of symbols, such as three "7" symbols, on reels 64-66 (FIG. 4A). If the game being played is poker based, the bonus-activating event may be occurrence of a certain hand, such as a royal flush. Furthermore, a bonus-activating event may occur when a player accumulates a number of symbols or game outcomes over a number of separate game plays. For example, a bonus-activating event may occur when the player receives three "bonus" symbols during a period of time. The bonus-activating event may be based on an external event. For example, a bonus-activating event may occur when a group of players obtain a certain result.

Jumbled Ball Display

With continuing reference to FIG. 4A, jumbled ball display 62 comprises a container 20 that is configured to hold a plurality of moveable display objects (display balls) 18. Container 20 is at least partially transparent allowing players to view display balls 18 inside of the container. Container 20 is made of a transparent material, such as acrylic, plastic or glass. Suitable containers of this type may be obtained from Tripp Plastics of Reno, Nev. However, container 20 may also be a wire cage of a type that is used in some Keno games.

Container 20 may have many different shapes (as previously described). In one embodiment, container 20 is substantially spherical with a partially flat back (not shown). The flat back allows container 20 to be large while still allowing animated gaming system 10 to be placed against a wall, another gaming device or other objects.

Although display balls 18 are typically similar to Keno balls, many other types of balls may be used. For example, display balls 18 may be ping-pong balls or rubber balls. Jumbled ball display 62 also comprises, an agitator (not shown in FIG. 1) to agitate or jumble display balls 18 within container 20. The agitator may be a stream of air or a mechanical mixing device. The agitator causes the balls to bounce and ricochet off of the walls of container 20. In one embodiment, a stream of air is used as an agitator and container 20 comprises an off-center opening for the stream of air. The opening is off-center to increase the initial agitation of display balls 18.

Fins (not shown) may also be provided at the bottom of container 20 to help agitate display balls 18. The fins support display balls 18 when they are resting at the bottom of container 20. This helps air circulate underneath display balls 18 to lift and separate the balls. The purpose of jumbled ball display 62 is to attract and entertain players. When display balls 18 are agitated, they produce a vivid display that attracts the attention of people nearby and provides an exciting display for players playing animated gaming system 10. Display Balls 18 are typically kept separate from balls used in prize object display 26.

Figure 4B:
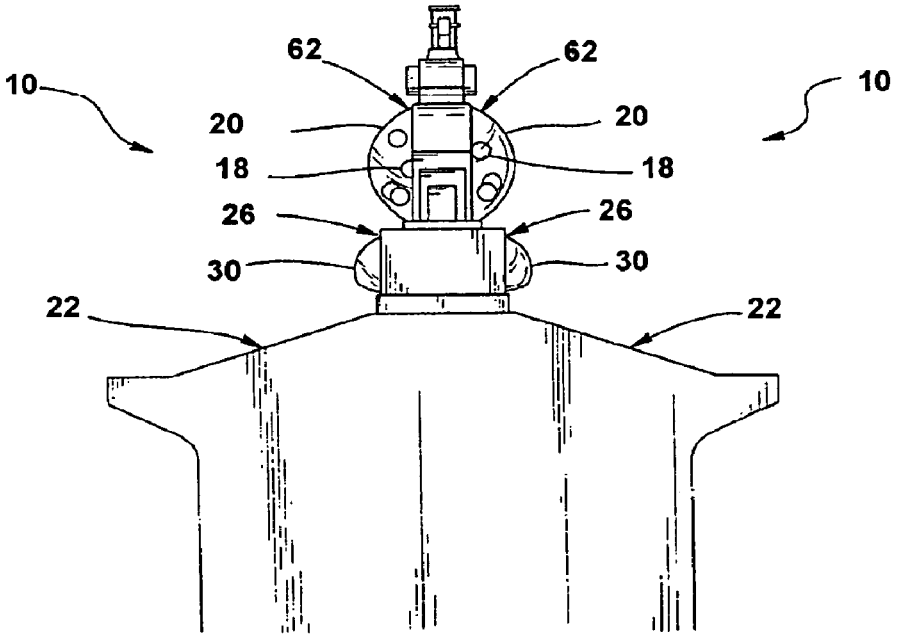
FIG. 4B is substantially a side view of an alternative embodiment of a portion of the gaming system of the present invention.

FIG. 4B represents an alternative embodiment of the present invention in which two animated gaming systems 10 are placed back to back. Each animated gaming system 10 comprises a game apparatus 22. Game apparatuses 22, shown in FIG. 4B are known as "slant top" models for their sloping upper surfaces. However, other types of gaming devices, such as the upright game apparatus 22 shown in FIG. 4A, may also be used.

In this embodiment, a separate jumbled ball display 62 is provided for each game apparatus 22. Each jumbled ball display 62 may comprise container 20 in the shape of a hemisphere. Containers 20 may be placed back to back so that the two containers have a spherical appearance when viewed from the side. Other shapes, such as cubes and cylinders, may also be used. A mirror may be placed at the back of each container 20 to enhance the appearance of the jumbled ball displays 62 by reflecting images of jumbled display balls 18 outward toward the players. Containers 20 may also be one single container that is divided in two by a mirror or other partition. Each container 20 has its own independently operated agitator and jumbled display balls 18. Each game apparatus 22 has its own independently operated prize object display 26 with display window 30.

Prize Object Display

Referring to FIGS. 1, 4A and 4B, prize object display 26 is configured to select a prize object (prize ball) 28 and display the prize ball to a player. When a bonus-activating event occurs, prize object display 26 senses this, selects a prize ball and displays the prize ball 28 in window 30.

Figure 5:
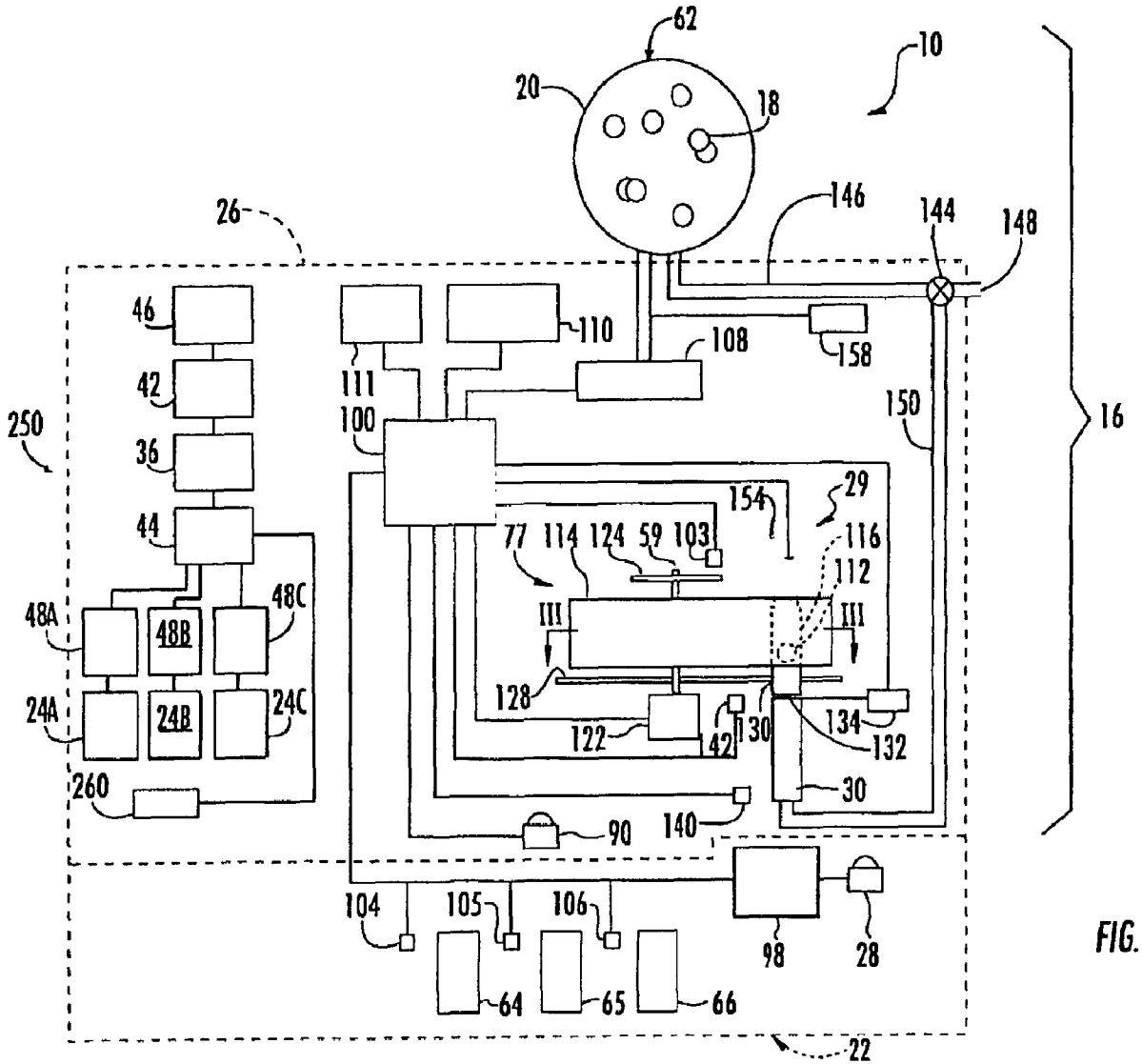
FIG. 5 is substantially a schematic diagram of a portion of the gaming system of the present invention.
Figure 5A:
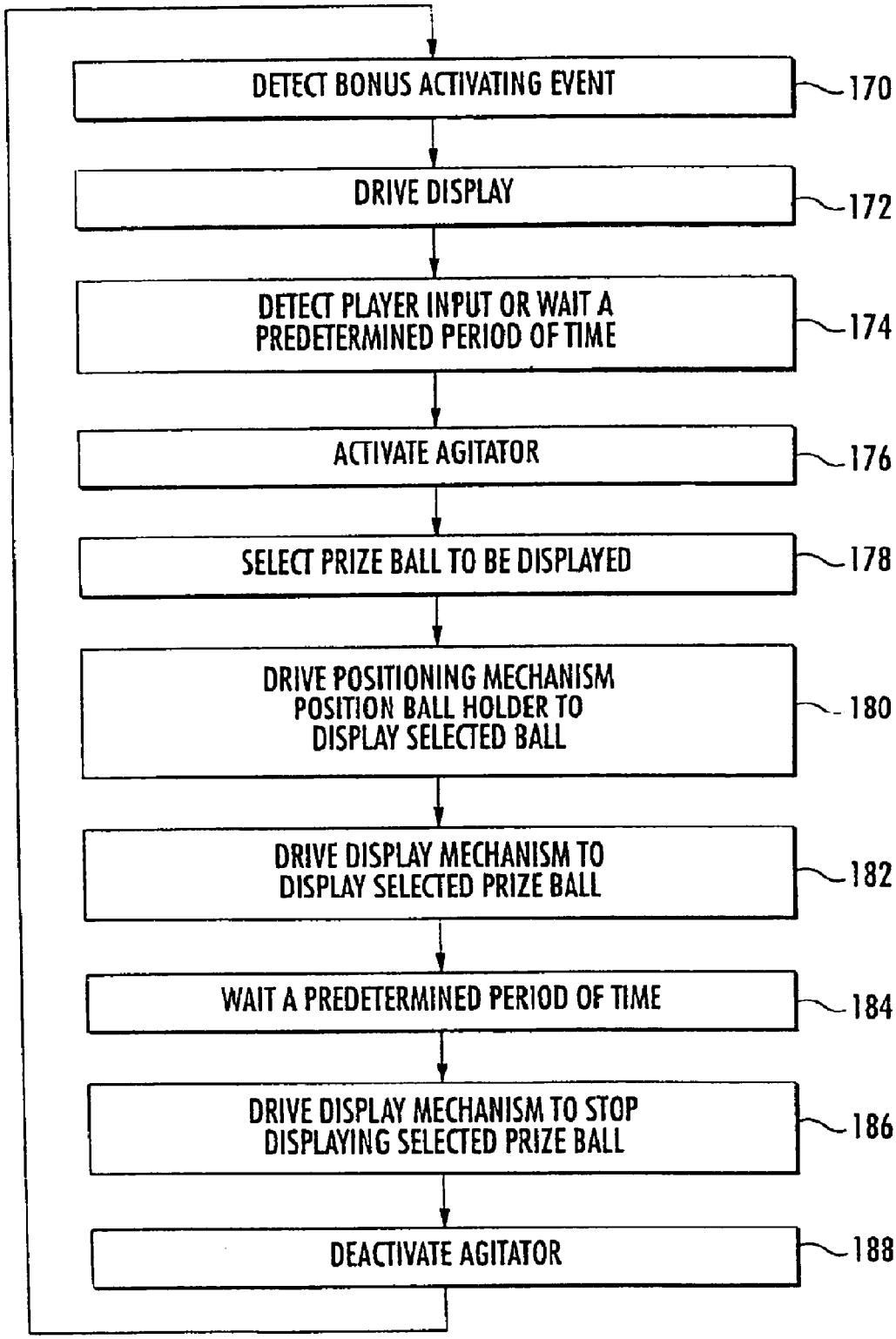
FIGS. 5A-5AB are substantially flow charts showing one of the many ways the gaming system may be operated.
Figure 5A:
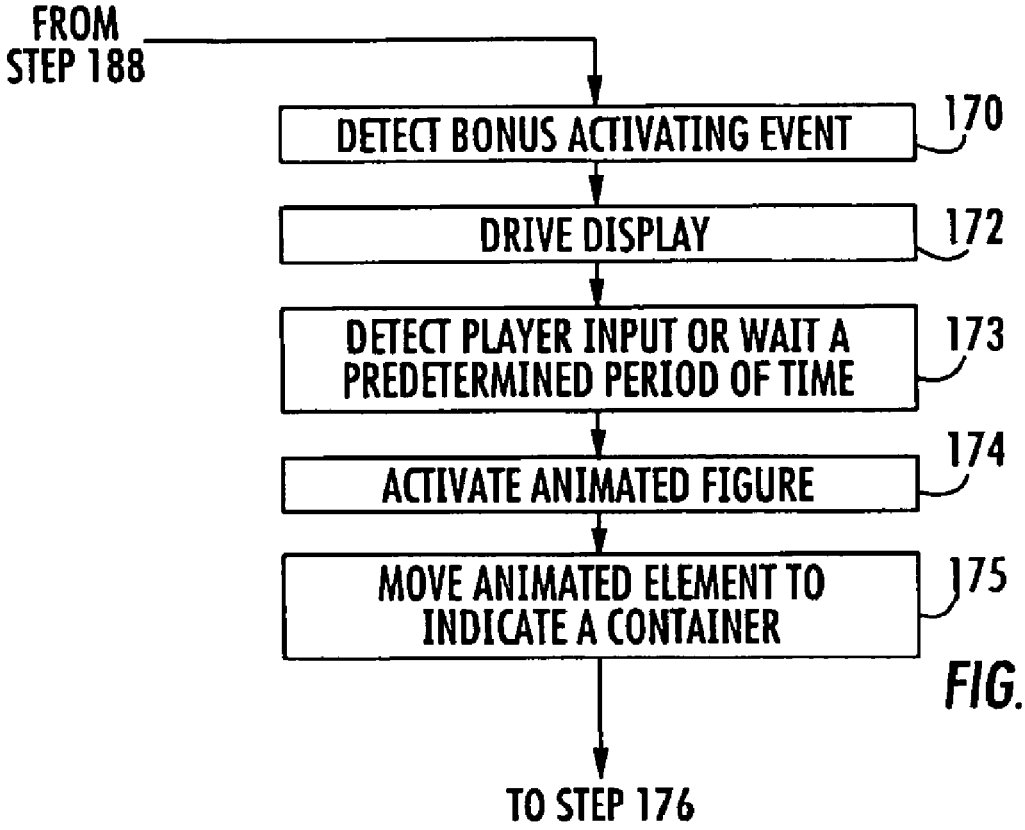
Figure 5A:
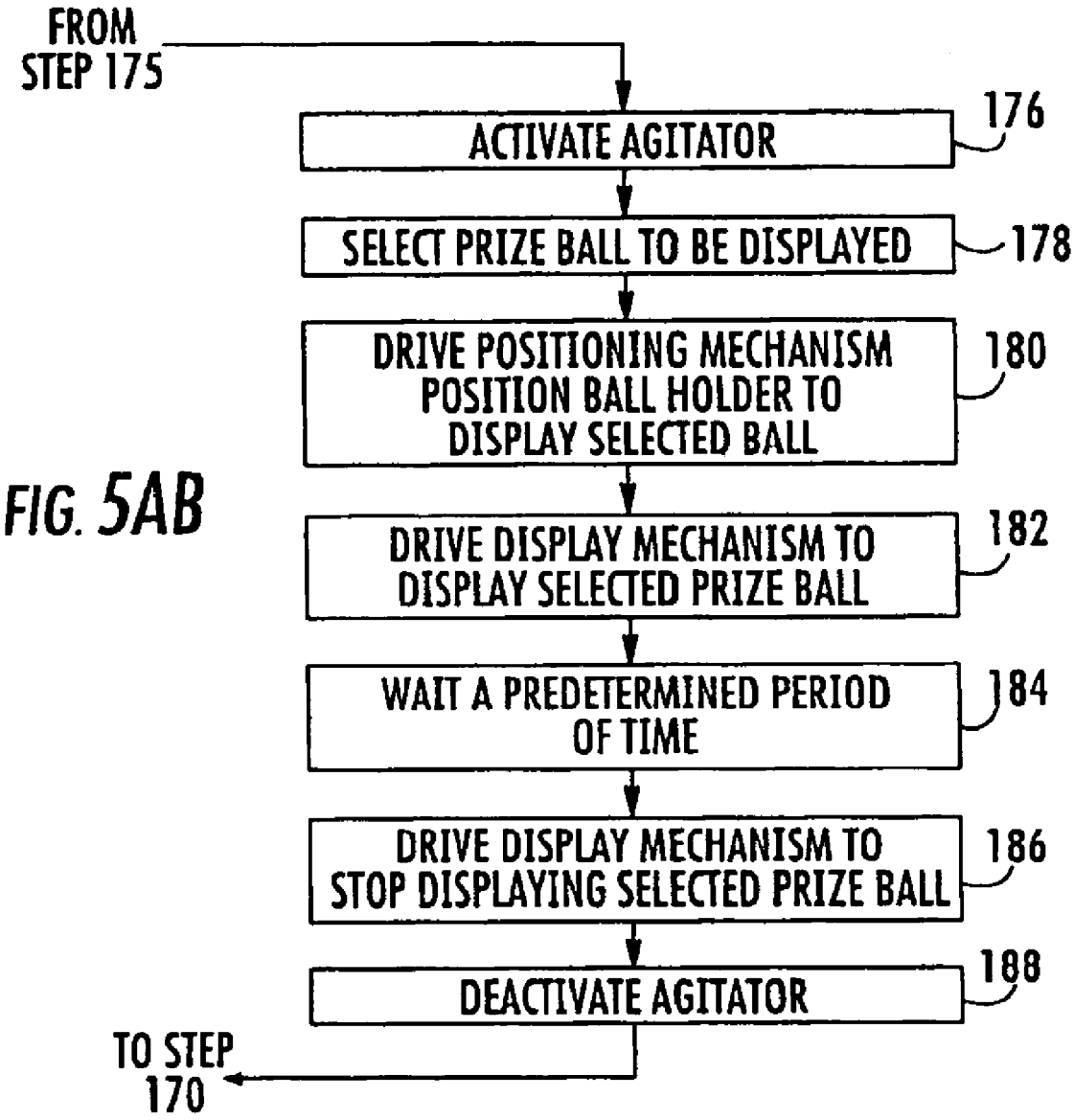
Figure 5B:
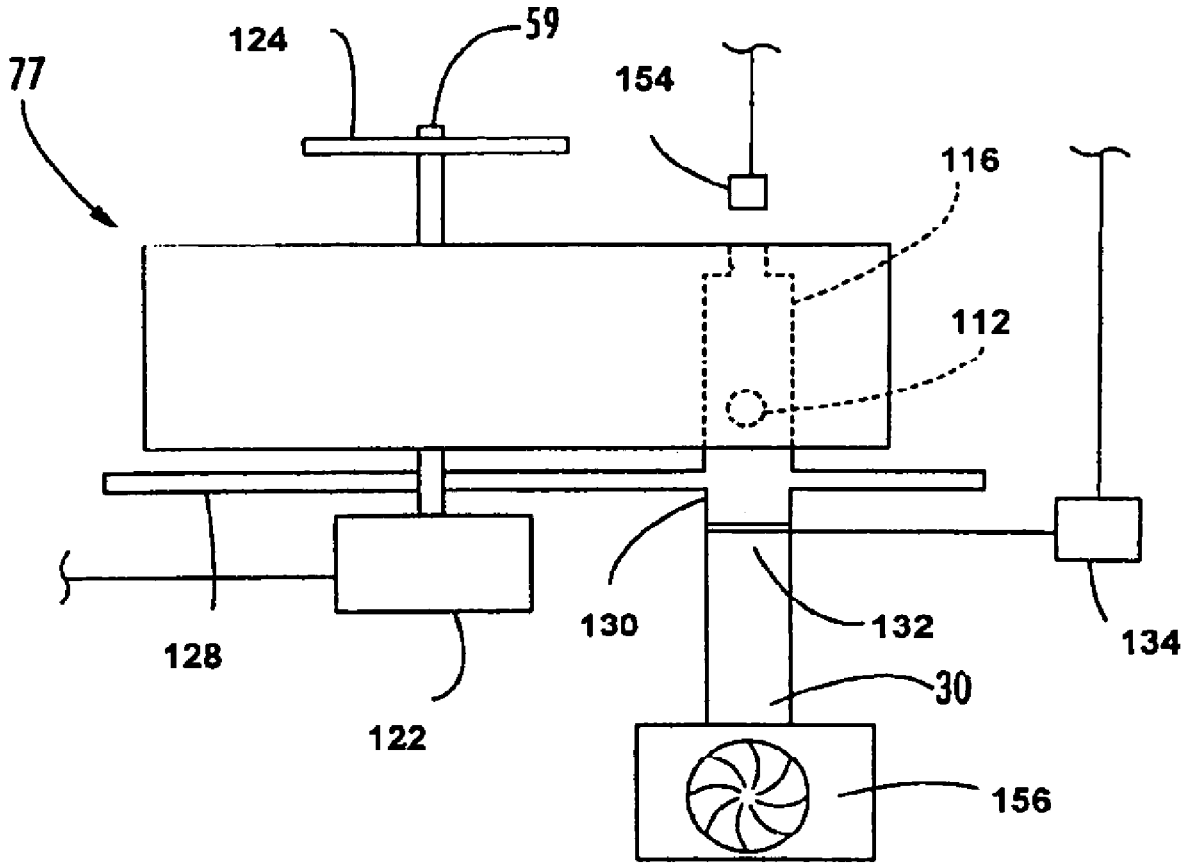
FIG. 5B is substantially a schematic diagram of an alternate prize ball display mechanism for use in the gaming system of FIG. 5.
Figure 5C:
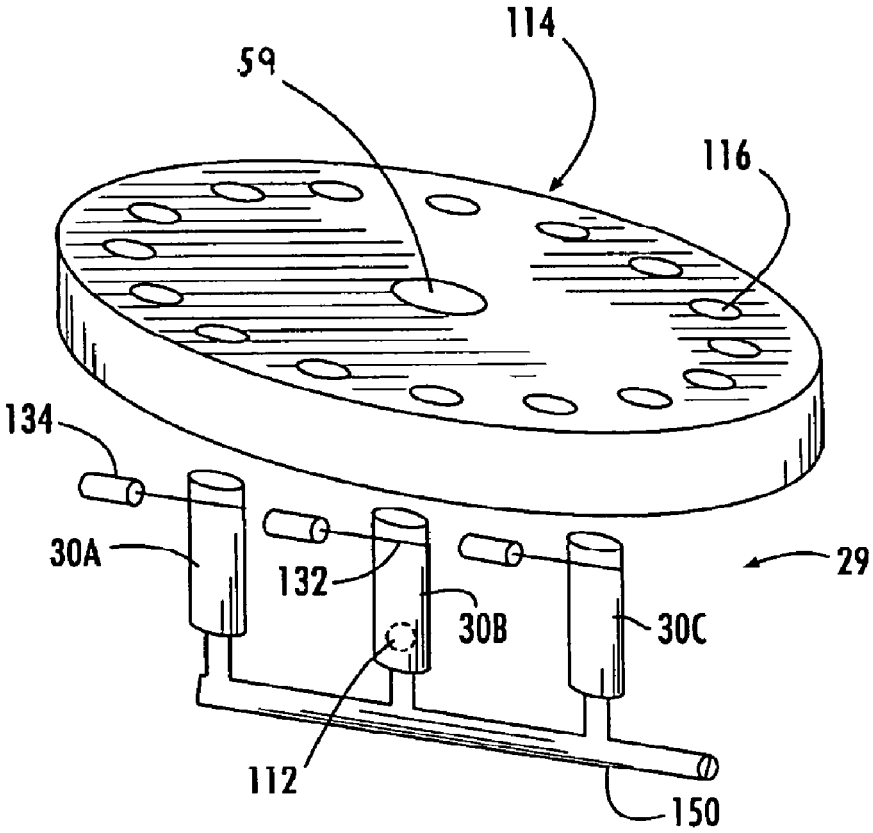
FIG. 5C is substantially an enlarged perspective view of the prize ball display of FIG. 5.

Turning now to FIGS. 5 and 5C, prize object display 26 comprises a controller 100 that is configured to control the operation of gaming system 10. Controller 100 may be one or more computers or processor boards. For example, in the presently implemented embodiment, controller 100 comprises a bonus controller and stepper motor controller. It is recognized that controller 100 may be a single processor or processor board. Furthermore, it is also recognized that controller 100 and controller 98 may be combined in a single processor or processor board. 1311 Controller 100 is configured to detect when a bonus activating event occurs in game apparatus 22. This may be accomplished by game apparatus controller 98 transmitting a signal to controller 100 that a bonus event has occurred. For example, controller 98 may determine the outcome of each game and when a bonus-activating outcome occurs, it transmits a signal to controller 100. Alternatively, controller 100 may periodically interrogate controller 98. In another embodiment, one or more sensors may be provided for determining if a bonus activating event has occurred. For example, sensors 104-106 may sense the positions of reels 64-66. When reels 64-66 are in a bonus activating position, controller 100 would sense this position and begin a bonus sequence (described below). Sensors may also be provided external to animated gaming system 10 to detect external bonus-activating events.

Controller 98 may also transmit a variety of information to controller 100. For example, controller 98 may signal when coins or currency have been inserted, when a game starts, when an error has occurred and when a sensor detects tampering.

When controller 100 detects a bonus-activating event, it may begin a bonus sequence by activating display 110 (see FIG. 4A). Display 110 may comprise many different kinds of display devices, such as, for example, video screens, lights and light emitting diodes. Display 110 may comprise its own controller that is adapted to generate a variety of displays. 134 Display 110 may indicate that a player has qualified for a bonus round and prompt the player to perform an action. In one embodiment, the player is prompted to activate the bonus sequence by pressing input device 90 (see FIG. 4A). Suitable input devices include, for example, a simple button, a keyboard, a mouse or a touch screen display. In the embodiment in which the player must accumulate a number of bonus symbols to qualify for a bonus, display 110 may indicate the number of symbols the player has received.

When controller 100 detects input device 90 being activated, controller 100 performs a routine to determine in which container 20*a,* 20*b* or 20*c* the display objects 18 will be agitated. This may be performed by a number of methods that are well known in the art. For example, one of containers 20 can be randomly selected. For clarity, only one of the three containers 20 is shown in FIG. 5. Controller 100 generates a random number and then compares the random number to a pay table similar to that described for game apparatus 22 (see previous discussion). The selected container information is then communicated to controller 36.

Controller 36 then activates a positioning mechanism 250. Positioning mechanism 250 is configured to position animated FIG. 12 so that animated element 24 can point to one of containers 20*a,* 20*b* and 20*c.* Positioning mechanism 250 may utilize a large variety of devices to achieve its purpose. For example, positioning mechanism 250 may include motor controller 44 and motors 48. Controller 36 can instruct motor controller 44 to move the appropriate motors 48*a,* 48*b,* and 48*c* to move at least one of arm 25*a,* hand 25*b* and finger 25*c.* For example, elements 25*a,* 25*b* and 25*c* can move such that a finger 25*c* points to or selects one of containers 20*a,* 20*b* or 20*c.* A sensor 260 can sense the position of animated FIG. 12 and ensure that the appropriate container is being indicated. Controller 36 can communicate the position of FIG. 12 to controller 100.

After the appropriate container has been indicated, controller 100 would activate the agitator in the selected container 20 or jumbled ball display 62. In another embodiment, the agitator comprises blower 108, which blows air into the selected container 20. Alternatively, the agitator may begin automatically and input device 90 may be used to initiate the display sequence. In another embodiment, controller 100 may wait a predetermined time period for the player to activate input device 90. If the player does not activate input device 90 in that time period, controller 100 would automatically activate the selected jumbled ball display 62 and initiate the display sequence. In yet another embodiment, controller 100 automatically initiates the display sequence in a predetermined time period, independent from input device 90, and input device 90 is only used to activate the selected jumbled ball display 62. It is understood that no input device may be used and controller 100 may automatically activate the selected jumbled ball display 62 and begin the display sequence.

In another embodiment input device 90 may be used by the player to provide a limited amount of control over movement of animated FIG. 12. For example, by use of input device 90 the player may cause animated FIG. 12 to indicate one specific container 20 of the at least two containers 20. Thus, the player is given the impression of some control over the outcome of the game without allowing the player to have any actual influence over the random game outcome and selection of the prize object 28.

To display a prize ball (prize object), controller 100 performs a routine to determine which prize ball will be displayed. This may be performed by a number of methods that are well known in the art. For example, prize balls 112 (analogous to prize object 28 in FIG. 1) may be sequentially displayed or displayed based on external events, such as certain bonus activating events may always cause the same prize ball to be displayed.

In another embodiment, however, prize balls 112 are randomly selected. Controller 100 generates a random number and then compares the random number to a pay table similar to that described for game apparatus 22 (see previous discussion).

Once controller 100 determines the prize ball to be displayed and the prize to be awarded, the controller activates a positioning mechanism 77. Positioning mechanism 77 is configured to position a selected prize ball 112 (that is separate from display balls 18) so that it can be displayed. Positioning mechanism 77 may utilize a large variety of devices to achieve its purpose. In one embodiment, all of the prize balls are held in a ball holder 114. Ball holder 114 may be made from a variety of materials, such as plastics, metals or composites. In one embodiment, ball holder 114 is cast high-density urethane foam that is machined to obtain a precise shape. In another embodiment, ball holder 114 is injection molded plastic.

Prize balls 112 typically have a similar appearance to display balls 18 in container 20. This creates the illusion that balls displayed in one of windows 30 originate from container 20. At least one of prize balls 112 has a symbol (game related indicium) that is capable of indicating a prize to be awarded to the player.

Prize balls 112 are stored in ball holder 114 in an individually controlled manner so that individual balls can be selectively removed from the prize object (ball) holder. This allows particular balls with particular symbols or values to be individually manipulated and displayed when desired. This may be accomplished in different ways. In one embodiment, ball holder 114 comprises a chamber 116 for each prize ball 112 stored in the holder. A prize display mechanism 29 is provided for removing ball 112 stored in chamber 116, displaying the ball, and replacing it in the chamber.

Figure 6:
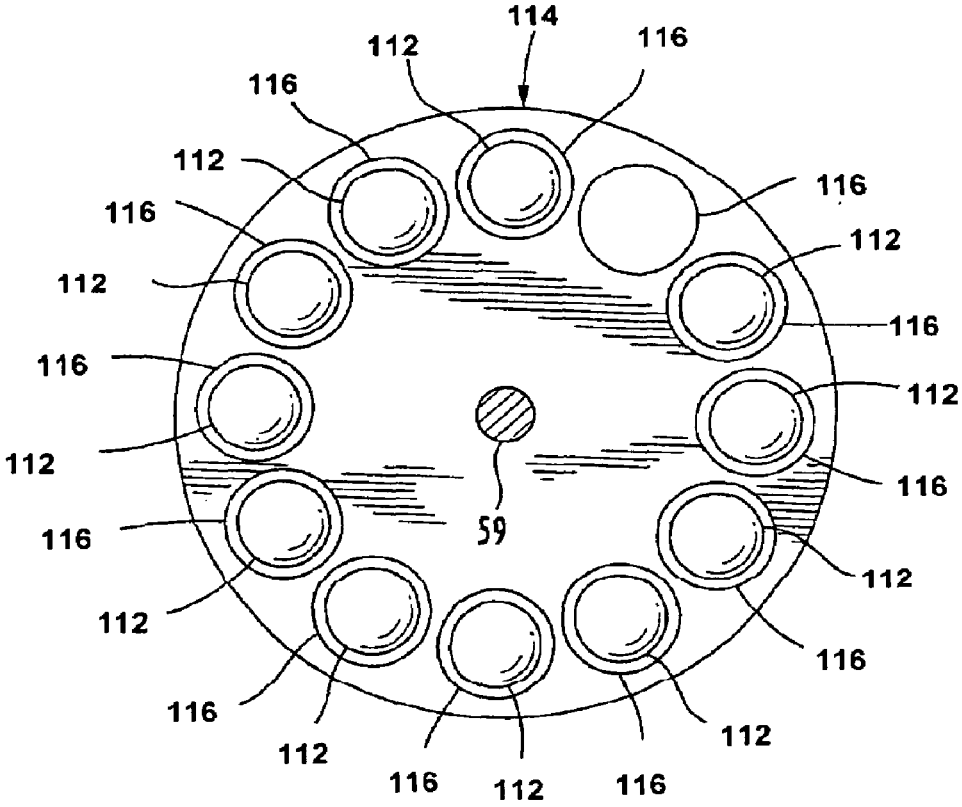
FIG. 6 is substantially a top cross sectional view of an embodiment of the ball holder of the present invention taken along line III in FIG. 5.
Figure 7:
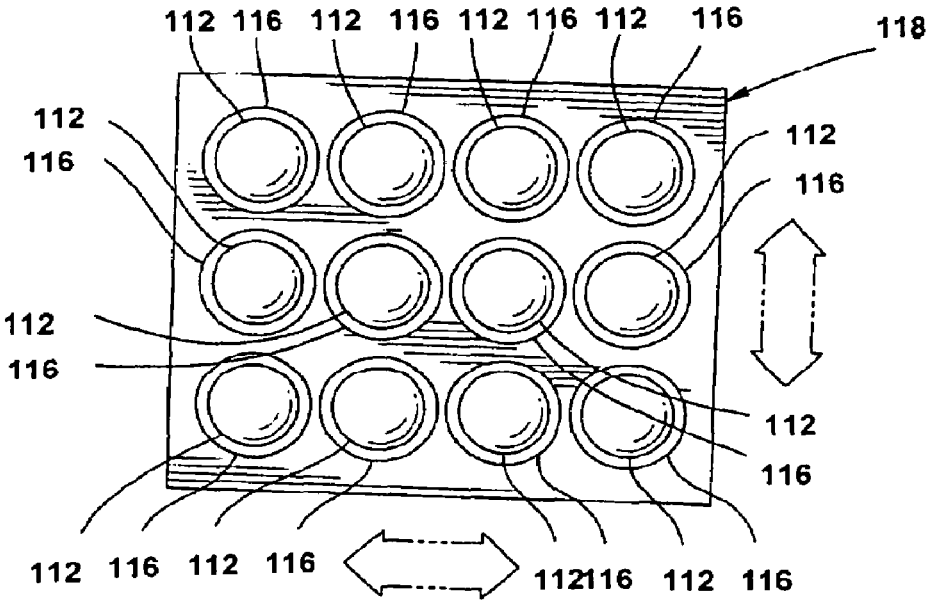
FIG. 7 is substantially a top cross sectional view of an alternative ball holder of the present invention.

In one embodiment, ball holder 114 is cylindrical as illustrated in FIG. 6. Chambers 116 are positioned outward from a central axis 59 of ball holder 114, near the periphery of the holder. Thus, chambers 116 may be positioned by rotating ball holder 114 around its central axis 59. Ball holder 114 may be provided in different configurations. For example, as shown in FIG. 7, ball holder 118 may be square or rectangular with chambers 116 arranged in rows and columns. In this embodiment, controller 100 is programmed with the location of chambers 116 and ball holder 118 is positioned by moving it laterally and longitudinally. Stepper motors and gears may perform the lateral and longitudinal positioning (not shown).

Returning to FIG. 5, positioning mechanism 77 comprises a stepper motor 122 for rotating holder 114. Wheel 124, rigidly attached to holder 114, and sensor 103, not attached to the holder, are provided for determining the angular position of the holder. Thus, controller 100 can position a ball 112 in holder 114 where it can be removed and replaced by rotating the holder and monitoring its angular position. The angular position of each prize ball 112 is stored in memory in controller 100. Sensor 103 may be an infrared source and detector and the periphery of wheel 124 may comprise portions with different reflective characteristics, such as physical holes or gaps or absorbent paint lines. Alternatively, an optical flag configuration similar to that described in U.S. Pat. No. 4,911,449, issued to Bertram, may be used.

Figure 8A:
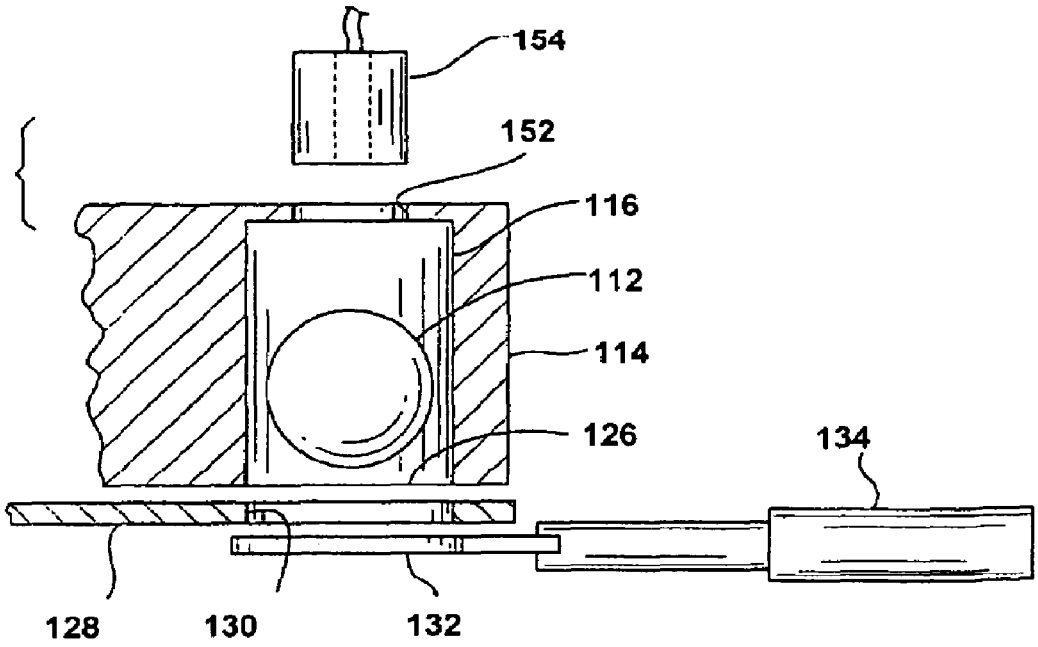
FIG. 8A is substantially an enlarged view of the ball holder shown in FIG. 5.

In one embodiment, holder 114 is arranged to allow the force of gravity to remove balls 112 from the holder. Referring now to FIGS. 5 and 8A, each chamber 116 has a lower opening 126 that is large enough for prize ball 112 to pass through. A plate 128 is provided on the lower surface of holder 114 for preventing prize balls 112 from falling out of chambers 112. A hole 130 is provided in one portion of plate 128 for allowing ball 112 to pass through the plate. A gate 132 blocks ball 112 until it is opened by an actuator 134. Gate 132 may cover the entire hole 130 or just a portion of it and it may be operated in a sliding or hinged manner. Actuator 134 may be an electrical solenoid actuator.

Figure 8B:
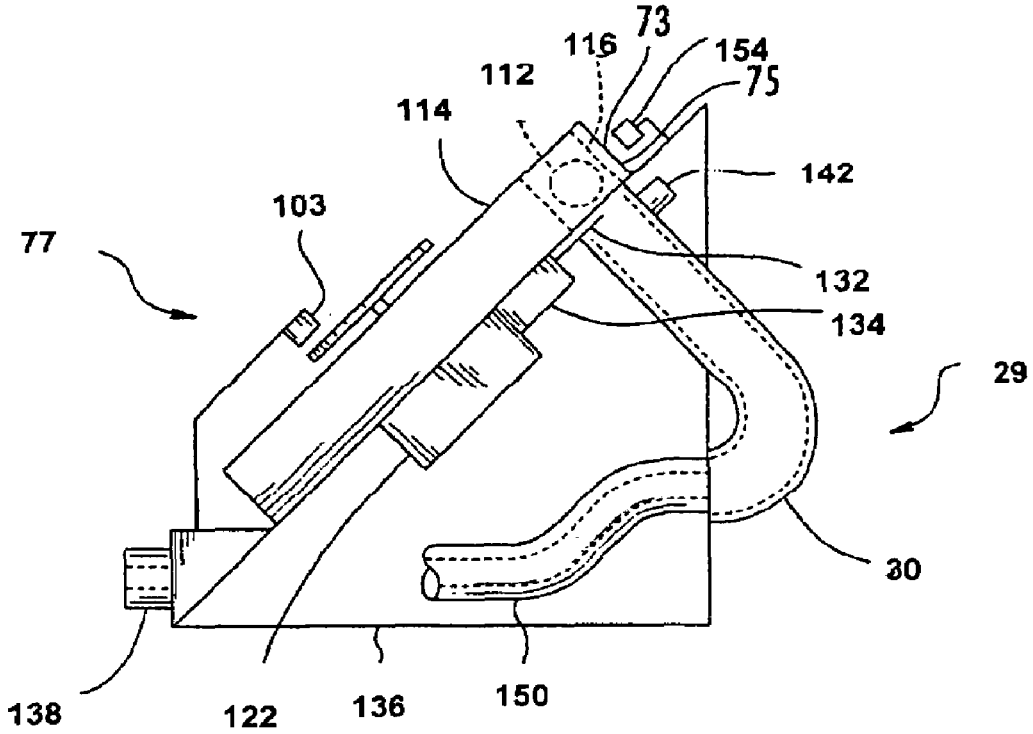
FIG. 8B is substantially a side elevational view of the positioning and display mechanisms of one embodiment of the present invention.

FIG. 8B represents another embodiment in which a chassis 136 supports ball holder 114 at approximately a forty-five degree angle to the vertical. Mounting grooves (not shown) may be provided in prize object display 26 for slidably receiving chassis 136 and connector 138 may be provided for connecting electrical circuits and devices to power supplies and controller 100. One of the advantages of this embodiment is that positioning mechanism 77 and display mechanism 29 can be easily serviced by removing chassis 136 from prize object display 26.

Referring to FIGS. 5, 5C and 8A, in normal operation, after controller 100 has determined which ball is to be displayed, the controller rotates holder 114 until the desired prize ball 112 is positioned over the selected display window 30*a*, 30*b* or 30*c* corresponding to containers 20*a*, 20*b* and 20*c* as previously selected by controller 100. Controller 100 stops holder 114 over the appropriate display window. For clarity, only one of the three display windows 30 is shown in FIGS. 5 and 8A. At the appropriate time, controller 100 activates actuator 134 to open gate 132. The force of gravity then pulls prize ball 112 downward through hole 130 into one of display windows 30. Display window 30 may be a chamber with a transparent or partially transparent wall that allows the player to see selected prize ball 112. In one embodiment, display window 30 comprises a tube that projects outward from the front surface of prize object display 26. This allows players to view prize ball 112 from many different angles and see symbols on the ball. Sensors 140 and/or 142 may be used to verify that prize ball 112 has fallen into display window 30. If sensors 140 and/or 142 do not detect ball 112 in its proper position, controller 100 may enter an error mode.

If the ball is detected in its proper position, controller 100 may cause display 110 to display the prize or reward, if any, that the player has won. Other effects may also be presented, such as pre-recorded sound from speakers. If the actual prize is money, the amount of the prize may be added to the player's credit meter or the prize may be dispensed from dispenser 111 or coin dispenser 88.

After ball 112 has been displayed long enough, controller 100 operates a valve 144 to divert exhaust air from container 20. While blower 108 is in operation, air is allowed to escape container 20 through an exhaust duct 146. Valve 144 is used to divert air from a vent 148 to a display duct 150. Display duct 150 directs air to the bottom of display window 30 where it blows the ball 112 upwards back into chamber 116. An upper opening 152 is provided in chamber 116 for allowing air to escape from the chamber thereby producing an air current. Sensors 154 and/or 142 may be used to verify that ball 112 has returned to chamber 116. If the ball is not detected in its proper position, controller 100 may enter an error mode and an attendant is called. In another embodiment, shown in FIG. 8B, sensor 154 is placed next to the peripheral wall 75 of ball holder 114 and a hole 73 is provided in the peripheral wall next to each chamber 116.

Components of the present invention may be arranged alternatively so that ball display window 30 is located above holder 114 and ball 112 is blown upwards into the display. When valve 144 is closed, the force of gravity pulls ball 112 back into chamber 116. In this alternate embodiment, once ball 112 has returned to chamber 116, controller 100 closes gate 132 by activating actuator 134, turns off blower 108, and waits for the next activating event.

A power failure or power surge could cause actuator 134 to malfunction and improperly open gate 132 while prize object display 26 is idle. This would cause prize ball 112 to fall out of chamber 116 into display window 30, thereby giving a false indication that the player had won a prize. In order to prevent this, in one embodiment, at least one chamber 116 does not have a prize ball 112 (see FIG. 6). This empty chamber is positioned over hole 130 whenever prize object display 26 is idle.

It is understood that other methods for agitating display balls 18 may be provided. In addition, other methods for actuating and displaying prize balls 112 may be used. The present invention is not limited to any particular method or apparatus for agitating or displaying display balls 18 and/or prize balls 112.

For example, in certain embodiments, including embodiments discussed further below, display balls 18 may be agitated by actuation of jumbled ball display 62. If display balls 18 are agitated by actuation of jumbled ball display 62, it may be desirable to employ other methods of actuating and displaying prize balls 112. For example, if an air compressor is not needed for agitation of display balls 18, it may be beneficial to modify the method of displaying prize balls 112 so that the air compressor may be eliminated from game apparatus 22.

For example, as illustrated in FIG. 5B rather than opening valve 144 to divert air to display duct 150 (as in FIG. 5), an air source or blower can be located below display window 30. For example, a fan 156 may be placed below one or more display windows 30. When activated by controller 100, fan 156 operates and creates a stream of air that blows display ball 112 in display window 30 back into chamber 116. Although many fans can be used, one suitable fan is DC brushless fan motor model number BG0703-B044-000 available from Minebea Co., Ltd. of Tokyo, Japan. It is understood that other air sources besides fans may be used without departing from the scope of the present invention.

Because some balls are very light, static electricity can cause the balls to stick to each other and to other components. To prevent this, a variety of static discharge devices 158 may be placed in various locations in the present invention. In the preferred embodiment, static discharge device 158 (FIG. 5) is a bare stranded copper wire with its strands spread out. The wire is placed in the flow of air between blower 108 and container 20 and wire is attached to a common ground.

Prize object display 26 of the present invention may also comprise means for simultaneously displaying a plurality of balls 112. To accomplish this, plate 128 may have multiple holes 130 (not shown), each with its own gate 132 and actuator 134, for supplying balls to multiple display windows. Thus, holder 114 may be positioned so that the appropriate ball is positioned over the appropriate hole 130 for supplying the appropriate display window 30. Alternatively, a plurality of ball holders 114 may be provided, each one supplying balls to a separate display window 30.

Figure 9:
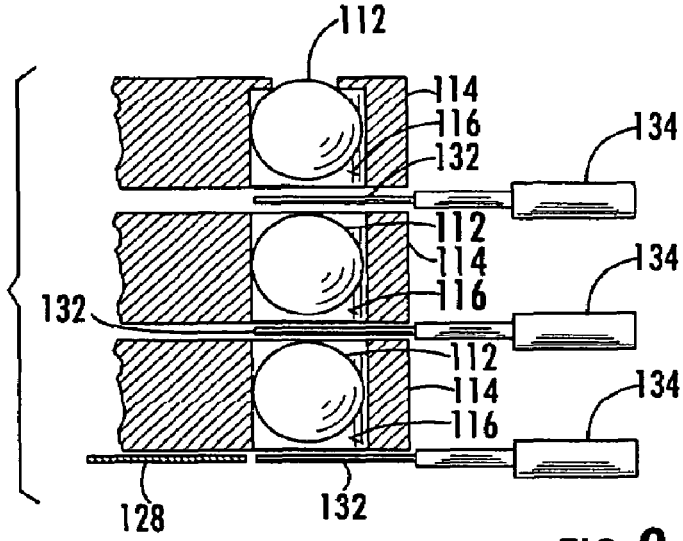
FIG. 9 is substantially a schematic diagram of an alternative embodiment of the present invention using multiple stacked ball holders.

In yet another embodiment, seen in FIG. 9, a plurality of separately controlled ball holders 114 are arranged in a stack. Each ball holder 114 is rotated to a position so that chambers 116 are aligned above display window 30 (FIG. 4A). Gates 132 are then opened and balls 112 are allowed to fall into display window 30. In this embodiment, display window 30 is large enough to display three balls simultaneously. When the display period has ended, balls 112 are blown back into chambers 116 and gates 132 are closed to separate and contain the balls. The action of gates 132 separates prize balls 112 into separate chambers 116.

With multiple balls being displayed, it is possible to use combinations of balls to indicate various bonus outcomes. It is also possible to replace the primary display of a gaming device with selector and prize object display device 26. In other words, game apparatus 22 may be entirely replaced with selector and prize object display device 26.

Figure 10:
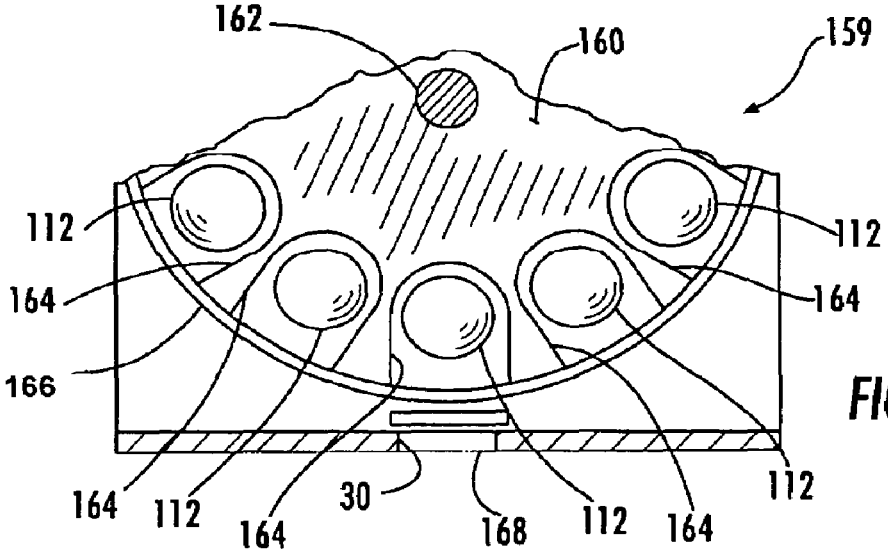
FIG. 10 is substantially an alternative display mechanism of the present invention.

As seen in FIG. 10, the present invention comprises an alternative display mechanism 159. Display mechanism 159 comprises a cylindrical ball holder 160 that may be rotated around its central axis 162. Ball holder 160 comprises a plurality of chambers 164 positioned along the periphery of the holder, each chamber is adapted to hold ball 112. Unlike the embodiment described in FIG. 5, it is not necessary to remove and replace balls 112 from chambers 164. Instead, at least a portion of the outer wall of each chamber 164 comprises a transparent material that allows players to view balls 112 inside the chamber. The transparent wall may comprise a ring of transparent material 166 that surrounds holder 160. A shutter device or door 168 may be provided between display window 30 and holder 160 for blocking the view of players while the holder is rotated. Although this embodiment has the advantage of a simpler mechanism, it may be less entertaining to players because it may be more apparent to the players that balls 112 do not originate from jumbled ball display 62.

Figure 4C:
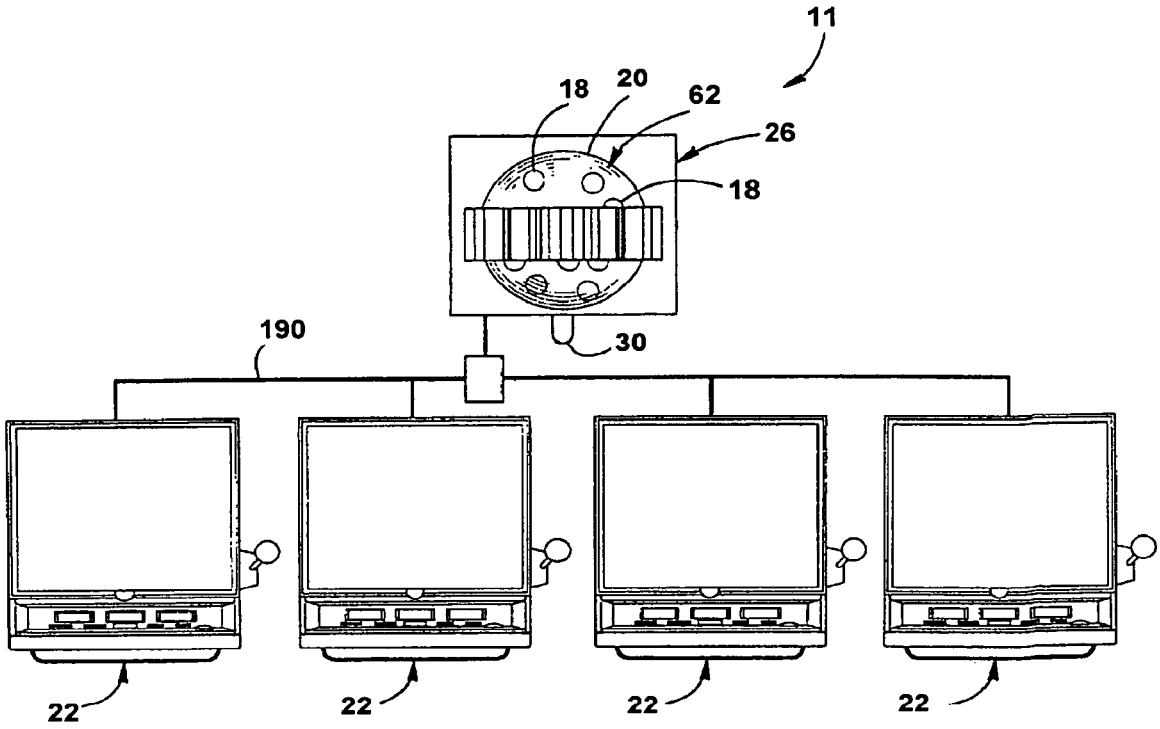
FIG. 4C is substantially a top schematic diagram of a portion of the display system of the present invention in use with a plurality of game apparatus.

As seen in FIG. 4C, a single display device 11 may also be used with a plurality of game apparatus 22. In this embodiment, each game apparatus is in communication with display device 11 by a communication device 190. Communication device 190 may be a network cable, such as an Ethernet cable, and appropriate hardware, such as network interface cards, may be included in display device 11 and game apparatus 22. When one of the game apparatus 22 produces a bonus-activating event, a signal is sent to display device 11. A prize ball may then be selected and displayed as described above.

Turning now to FIGS. 5AA and 5AB, the operation of prize object display 26 begins when controller 100 detects a bonus-activating event 170. Controller 100 may then drive display 110 to display an appropriate presentation or message at step 172. As discussed above, controller 100 may wait for player input from input device 90 (shown in FIG. 5) or it may wait for a predetermined period of time at step 174. Controller 100 activates the animated figure at step 174 and moves at least one animated element to point to at least one of the containers at step 175. Next, the agitator is activated in step 176 and a prize ball to be displayed is selected in step 178 from ball holder 114. Controller 100 then drives positioning mechanism 77 to position ball holder 114 so that the selected prize ball may be displayed at step 180 and causes display mechanism 29 to display the selected ball at step 182. Controller 100 may then wait a predetermined period of time so that the player may see the displayed prize ball in step 184, after which it causes display mechanism 29 to stop displaying the selected prize ball and return the prize ball to storage at step 186. The agitator is then deactivated at step 188 and controller 100 returns to a monitoring state to detect the next bonus activating event in step 170.

Alternative Jumbled Ball Display Embodiments

The jumbled ball display embodiment may include a display container rotatably mounted on the top of the gaming machine housing, using a rotating drive assembly, including drive gears and other appropriate support structure. The containers used as part of the jumbled ball display may also be of various shapes, for example, spherical (globe-shaped), prism-like (diamond-shaped), cubic or cylindrical. Containers may be made up of windowpanes made from a variety of materials, such as, for example, tempered glass or clear or colored acrylic, such as aesthetically attractive lightly blue-tinted acrylic available from Tripp Plastics, Inc., Reno, Nev.

The rotatable display containers provide a rotating agitated moveable object container that attracts attention to the underlying gaming machine, as well as to any other associated machines in the vicinity of the underlying gaming machine. These embodiments also can provide the impression that prize balls are selected from this container, while avoiding problems—such as environmental or regulatory problems—associated with game ball selection of an outcome-determinative game ball from agitated game balls in a container. These embodiments can thus allow a game player to play a keno-like or other game ball or action unit selection game, while avoiding environmental or regulatory problems associated with games that select from among visible, agitated action balls or other action units to provide outcome or award balls for display to the game player.

In another embodiment, the jumbled ball display may be in the form of a cage-type display, such as an actual cage formed from wire mesh and configured to hold a number of moveable display objects, such as balls. As used herein, the term "cage" is used to refer to an actual cage, a replica, or a representation of a cage, and may be constructed of molded plastic or sheet metal. Typically, the cage-type display may be in the form of a hollow cylindrical container. The cage-type displays are typically provided with accent lighting in order to enhance the visual appearance of the gaming device and to attract attention to the gaming device. For example, when the cage-type display is a cylindrical object, lights may be placed on the ends of the cylinder. Various types of lights can be used, including, for example, LED, fluorescent, neon, and incandescent lights. The cage-type display may be fixed or may be rotatably mounted to a game apparatus. In an embodiment where a cage-type display is fixed, a variety of agitators described above, such as an air stream or a mechanical mixer, may be used to stir the display balls.

Another embodiment can provide a rotatable container of agitated display balls that are also typically relatively inaccessible to general environmental influences on the outcome of the game. This embodiment can, in addition, provide a display device that reduces the risk of tampering, requires no human operators, and requires little maintenance. These display balls can add excitement and more realism to the gaming experience provided by the gaming machine and can add a separate game ball selector display that is also typically relatively inaccessible to general environmental influences during use of the gaming machine to play a game.

In another embodiment involving games using containers in conjunction with jumbled ball displays (such as described in U.S. Pat. No. 6,338,678) where a ball holder is contained within a prize display area to display one or more moveable objects (such as any type of ball, for example, keno balls, ping-pong balls or rubber balls), various transport devices may be included within the container area to provide moveable objects access to a moveable object dispenser (such as described in copending patent application U.S. Ser. No. 10/883,489, filed Jun. 30, 2004). In this embodiment, the containers typically include a floor having a receptacle configured to collect the moveable objects. A platform may be located that is suspended substantially within the top half of the container for receiving one or more moveable objects from an appropriate transport device. In one embodiment the container may simulate a popcorn popper, such as an old fashioned kettle corn popper. Suitable transport devices may include, for example, conveyor belts, discs, wheels, lifts, claws and augers. The various transport devices may further include at least one transport component such as, for example, cups, bowls, scoops, buckets, ledges, shovels and blades, cooperating with the transport device and configured to receive the one movable objects (for example, a ball) from the receptacle.

CONCLUSION

It can now be seen that the present invention solves many of the problems associated with the prior art. The present invention provides an animated gaming system that may be used as a primary game or a bonus game or in combination with a primary game. Although the description above contains many specifications, these should not be construed as limiting the scope of the invention but as merely providing illustrations of some of the presently preferred embodiments of this invention. The specification, for instance, makes reference to bonus prizes. However, the present invention is not intended to be limited to bonus prizes. Rather it is intended that the present invention can be used independently as a stand-alone game. Thus, the scope of the invention should be determined by the appended claims and their legal equivalents rather than by the examples given.

We claim:

1. An animated gaming system comprising:

(A) at least one game apparatus configured to allow a player to play a game;

(B) at least one housing coupled to the game apparatus;

(C) a plurality of moveable display objects displaying game related indicia;

(D) at least two containers coupled to the housing, each configured to hold the plurality of moveable display objects, wherein each container comprises at least one portion that is at least partially transparent, and wherein the player may view the moveable display objects in the container;

(E) at least one agitator associated with the containers and configured to agitate the moveable display objects inside each of the containers;

(F) a plurality of prize objects displaying game related indicia;

(G) at least one prize object holder located in the housing, the prize object holder being configured to hold the prize object in an individually controlled manner;

(H) a prize display mechanism operatively coupled to the prize object holder, the prize display mechanism being configured to display a selected prize object to the player;

(I) at least one three-dimensional animated figure coupled to the housing, the animated figure comprising at least one animated element being at least part of, or operatively coupled to, the animated figure, wherein the animated element is moveable between at least two positions, and wherein in at least one position, the animated element indicates at least one of the containers; and (J) at least one controller in communication with the game apparatus, wherein the controller is configured to present the game to the player, to determine a game outcome and select a prize object from the prize object holder corresponding to the game outcome, and wherein the controller is further in communication with the prize display mechanism to cause the prize display mechanism to display the selected prize object.

2. The animated gaming system of claim 1 wherein the animated figure further comprises a second animated element being at least part of, or operatively coupled to, the animated figure, wherein the second animated element is moveable between at least two positions.

3. The animated gaming system of claim 1 further comprising a positioning mechanism in communication with the controller and attached to the prize object holder, wherein the positioning mechanism is configured to position the selected prize object for display by the prize display mechanism.

4. The animated gaming system of claim 1 further comprising an input device in communication with the controller, the input device being configured to enable the controller to cause display of the selected prize object when the player activates the input device.

5. The animated gaming system of claim 1 wherein the selected prize object appears to originate from the plurality of moveable display objects in the container.

6. The animated gaming system of claim 1 wherein the at least one prize object holder is configured such that the prize object in the prize object holder is hidden from view of the player.

7. The animated gaming system of claim 1 wherein the plurality of moveable display objects are balls and the at least two containers comprise a jumbled ball display.

8. The animated gaming system of claim 1 wherein the animated figure is selected from the group consisting of representations of all or part of an animal, a bird, a human, a human-like figure, a boat, an automobile and a train car, and wherein the animated figure is configured to display spontaneous life-like motion.

9. The animated gaming system of claim 1 further comprising at least one actuator-located in the housing, in communication with the controller, and coupled to the animated element wherein the actuator moves the animated element in response to a signal sent by the controller.

10. The animated gaming system of claim 9 wherein the actuator is selected from the group consisting of a stepper motor, a servo motor, a gear motor, a worm gear and a DC motor.

11. The animated gaming system of claim 1 further comprising a changeable display portion located in the housing that displays changing images to the player.

12. The animated gaming system of claim 11 wherein the game related indicia displayed on the prize object is correlated with the images displayed on the changeable display portion.

13. The animated gaming system of claim 1 further comprising a display covering disposed over at least a portion of the housing wherein the animated figure may be viewed from outside the housing through the display covering, the display covering being configured to provide an aperture through which a portion of the animated figure extends from an interior of the housing and outside the display covering.

14. The animated gaming system of claim 1 further comprising at least two container rotating drives in association with the housing and the at least two containers, whereby the container rotating drives may rotate the at least two containers.

15. A method for operating an animated gaming system comprising the following steps, but not necessarily in order shown:

(a) allowing a player to place a wager and play a game of chance having a random game outcome;

(b) determining the random game;

(c) displaying a plurality of moveable display objects in at least two containers, the moveable display objects displaying game related indicia, and the containers allowing the player to see the moveable display objects;

(d) providing a plurality of prize objects displaying game related indicia wherein the prize objects are separated from the moveable display objects;

(e) moving at least a portion of a moveable three-dimensional animated figure to indicate one of the at least two containers;

(f) selecting a prize object from a prize object holder wherein a selected prize object corresponds to the random game outcome; and (g) displaying the selected prize object.

16. The method of claim 15 further comprising storing the plurality of prize objects in an individually controlled manner.

17. The method of claim 15 further comprising displaying the selected prize object such that the selected prize object appears to the player to originate from the plurality of moveable display objects in the containers.

18. The method of claim 15 further comprising hiding the plurality of prize objects in the prize object holder from view of the player.

19. The method of claim 15 further comprising allowing the player to control movement of the moveable three-dimensional animated figure to indicate one of the containers by use of an input device.

20. An animated gaming system comprising:

(A) at least one game apparatus means for allowing a player to place a wager and play a game of chance;

(B) at least one housing means for displaying components of the game;

(C) a plurality of moveable display object means for providing game activity;

(D) at least two container means for retaining the moveable display object means, the container means comprising at least one portion that is at least partially transparent;

(E) at least one agitator means for moving the moveable display object means in the container means;

(F) a plurality of prize object means for displaying game related indicia;

(G) at least one prize object holder means for holding the prize object means in an individually controlled manner;

(H) a prize display means for displaying a selected prize object means to the player;

(I) at least one three-dimensional animated figure means comprising at least one animated element means for providing movement between at least two positions to indicate at least one of the container means; and (J) at least one controller means for presenting the game to the player, determining a game outcome, selecting a prize object means from the prize object holder means, and causing the prize display means to display the selected prize object means.

21. The animated gaming system of claim 20 further comprising a positioning mechanism means for positioning the selected prize object means for display by the prize display means.

22. The animated gaming system of claim 20 further comprising an input device means for enabling the controller means to display the selected prize object means when the player activates the input device means.

23. The animated gaming system of claim 20 further comprising at least one actuator means for moving the animated element means of the three-dimensional animated figure means in response to a signal sent by the controller means.

24. The animated gaming system of claim 20 further comprising a changeable display means for displaying changing images to the player.

25. A gaming device comprising:

(A) a plurality of containers that are adapted to hold a plurality of moveable display objects, the display objects having game related indicia, wherein each container comprises at least one portion that is at least partially transparent, and wherein the player may view the moveable display objects in the container;

(B) at least one prize object holder, the prize object holder being configured to hold a plurality of prize objects, the prize objects displaying game related indicia;

(C) a prize display mechanism coupled to the prize object holder, the prize display mechanism being configured to display a selected prize object to the player;

(D) at least one animated figure mounted adjacent the containers, the animated figure being adapted to indicate at least one of the containers; and (E) a controller, wherein the controller is in communication with and is configured to control the animated figure, the prize object holder and the prize display mechanism.

26. The gaming device of claim 25 wherein the animated figure has at least one animated element, the animated element being moveable.

27. The gaming device of claim 26 wherein the animated element is adapted to point to one of the containers.

* * * * *